US010146150B2

(12) United States Patent
Ikada et al.

(10) Patent No.: US 10,146,150 B2
(45) Date of Patent: Dec. 4, 2018

(54) PROCESS CARTRIDGE, IMAGE FORMING APPARATUS, IMAGE FORMING METHOD

(71) Applicant: CANON KABUSHIKI KAISHA, Tokyo (JP)

(72) Inventors: Kosuke Ikada, Numazu (JP); Norihito Naito, Numazu (JP); Takayoshi Kihara, Mishima (JP); Masataka Mochizuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/605,190

(22) Filed: May 25, 2017

(65) Prior Publication Data

US 2017/0351192 A1 Dec. 7, 2017

(30) Foreign Application Priority Data

Jun. 1, 2016 (JP) ..... 2016-110417
May 1, 2017 (JP) ..... 2017-091436

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/0275; G03G 15/55; G03G 2215/00071
See application file for complete search history.

(56) References Cited

U.S. PATENT DOCUMENTS 6,985,680 B2 * 1/2006 Sakai ..... G03G 15/0266 399/50
9,298,124 B2 3/2016 Araki et al.
10,001,719 B2 * 6/2018 Kihara ..... G03G 15/0266
2002/0150831 A1 * 10/2002 Ehara ..... G03G 5/08214 430/123.41
2005/0164104 A1 * 7/2005 Tong ..... G03G 5/0546 430/58.05
2006/0251438 A1 * 11/2006 Uchitani ..... G03G 15/0266 399/50

FOREIGN PATENT DOCUMENTS

CN 103926435 A * 7/2014
JP 2002-365859 A 12/2002
JP 2004-157501 A 6/2004
JP 2006-276056 A 10/2006
JP 2011-118234 A 6/2011
JP 2012-103304 A 5/2012
JP 2013-190626 A 9/2013
JP 2015-158602 A 9/2015

* cited by examiner

*Primary Examiner* — Francis C Gray
(74) *Attorney, Agent, or Firm* — Fitzpatrick, Cella, Harper & Scinto

(57) ABSTRACT

At least one partial measurement region is set in the longitudinal direction in a printable region of a photosensitive drum. After the photosensitive drum has been charged to a constant potential with a charging roller, different potentials are set in the partial measurement region and a region excluding the partial measurement region with a laser scanner, partial discharge information of the partial measurement region is detected by a discharge information detection unit, and a bias voltage in image formation that is applied to the charging roller is corrected on the basis of the value of the partial discharge information.

11 Claims, 22 Drawing Sheets

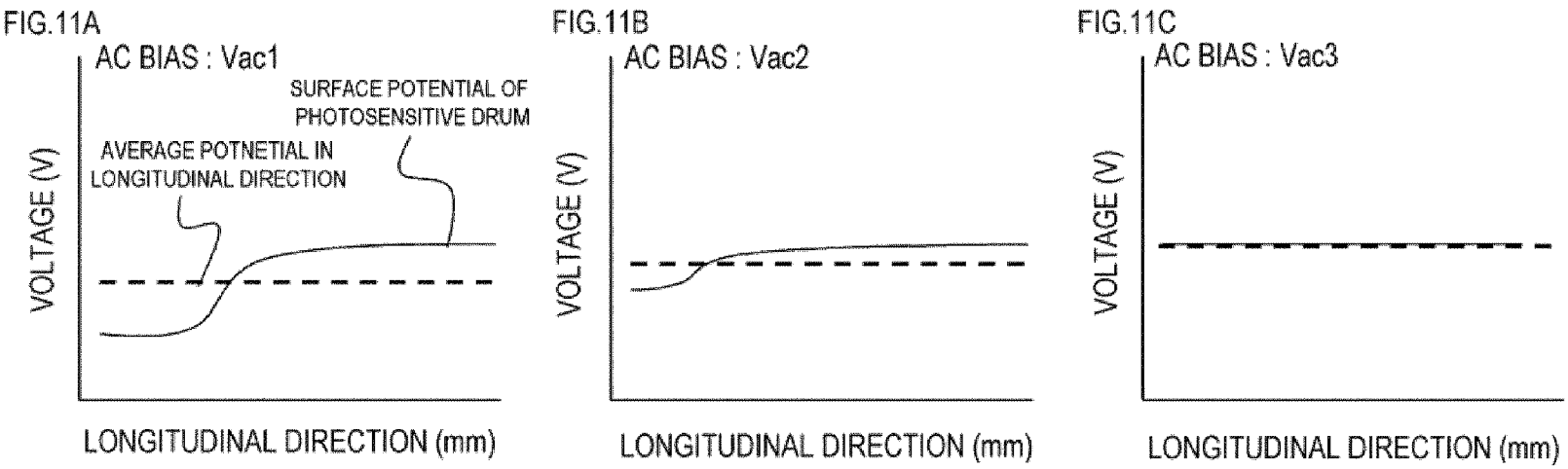
POTENTIAL IN LONGITUDINAL DIRECTION OF PHOTOSENSITIVE DRUM (Vac1 <Vac2 <Vac3)

PROCESS CARTRIDGE, IMAGE FORMING APPARATUS, IMAGE FORMING METHOD

BACKGROUND OF THE INVENTION

Field of the Invention

The present invention relates to an image forming apparatus provided with a charging device that charges a member to be charged via a charging member.

Description of the Related Art

The conventional process realized in an image forming apparatus using an electrophotographic method includes a step of uniformly charging the surface of a drum-type electrophotographic photosensitive member (referred to hereinbelow as a photosensitive drum) to a predetermined potential.

For example, a contact charging method in which a roller charging member (referred to hereinbelow as a charging roller) is brought into contact with the surface of a photosensitive drum and a voltage is applied to the charging roller to charge the photosensitive drum is presently mainly used as charging means.

A method for applying a DC voltage and a method for superimposing an AC voltage on a DC voltage and alternately causing discharges to the plus side and minus side to realize uniform charging are used for applying a voltage to the charging roller. In the latter method, a resistive load current flowing through a resistive load between the charging roller and the photosensitive drum, a capacitive load current flowing in the capacitive load between the charging roller and the photosensitive drum, a discharge current between the charging roller and the photosensitive drum, and a current which is a sum total of those currents flow through the charging roller. It has been empirically established that in this case stable charging is obtained when a discharge current amount is equal to or greater than a predetermined value.

FIG. 18 shows the characteristic of a current Ic flowing through the charging roller when an AC voltage Vc is applied to the charging roller. The AC voltage Vc indicates the peak voltage value of the AC voltage, and the current Ic indicates the effective value of the AC current. It follows from FIG. 18 that when the amplitude of the AC voltage Vc is gradually increased, the charging current increases accordingly. When the AC voltage is not more than twice a predetermined voltage Vh, the amplitude of the AC voltage and the charging current are substantially proportional to each other. This is because the resistive load current and the capacitive load current are proportional to the voltage amplitude, and the discharge phenomenon does not occur and the discharge current does not flow due to a small voltage amplitude. Further, where the AC voltage is further increased, the discharge phenomenon starts at a voltage twice the predetermined voltage Vh. At this time, the charging current Ic deviates from the proportional relationship and is increased by the amount corresponding to the discharge current Is. Here, in order to ensure stable charging, it is necessary to set the AC voltage Vc so that the discharge current Is becomes equal to or higher than a predetermined value.

However, when the discharge amount to the photosensitive drum is increased, deterioration of the photosensitive drum such as scraping of the photosensitive drum is advanced, and abnormal images such as an image flow in a high-temperature and high-humidity environment created by discharge products may occur. Therefore, to obtain stable charging and to solve the aforementioned problem, it is necessary to control voltage application to a minimum necessary limit at which the discharge amount is suppressed as much as possible. However, the relationship between the voltage applied to the photosensitive drum and the discharge amount is not always constant, and varies depending on the film thickness of the photosensitive layer or dielectric layer of the photosensitive drum, the charging member, and environmental fluctuation of air, and the like. It has been found that problems associated with changes in the discharge amount are caused not only by the environmental fluctuation, but also by variation in the resistance value of the charging member caused by spread in production conditions and contamination, variation in the electrostatic capacity of the photosensitive drum associated with durability, and spread in characteristics of the high-voltage generator of the image forming apparatus.

A "discharge current control method" has been suggested (see, for example, Japanese Patent Application Publication No. 2004-157501) to suppress such a change in discharge amount. In the suggested control method, the peak voltage of the AC applied voltage applied to the charging roller and the peak voltage of the differential waveform thereof are detected to calculate the discharge current value (see Japanese Patent Application Publication No. 2004-157501).

SUMMARY OF THE INVENTION

However recent advances in the extension of service life of image forming apparatuses and diversification of methods for use thereof in the market sometimes lead to unevenness of contamination in the direction perpendicular to the image forming process direction of the charging roller (referred to hereinbelow as "longitudinal direction") and film thickness unevenness in the longitudinal direction of the photosensitive drum. These problems sometimes occur, for example, when the output of a print pattern having a deviation in the printing portion in the longitudinal direction is continued or when an image forming apparatus of a system in which the recording material directly contacts the photosensitive drum continuously uses small-size recording materials such as envelopes or postcards.

When the film thickness unevenness in the longitudinal direction of the photosensitive drum or unevenness of contamination in the longitudinal direction of the charging roller occurs, the impedance at the time the current flows from the charging roller to the photosensitive drum varies in the longitudinal direction, and there appear a portion where the discharge is likely to proceed and a portion where the discharge is unlikely to proceed. In this case, in the discharge current control method, since the discharge amount in the entire longitudinal direction is detected, there can be a portion where the discharge amount is lower than the appropriate amount or a portion where the discharge exceeds the appropriate value and scraping of the photosensitive drum is advanced. In the portion where the discharge is unlikely to proceed, the charging becomes unstable, over-discharged portions and under-discharged portions appear locally, and when the under-discharged portions are developed by the developing portion, black spots appear in the white background portions therein. As a result, image defects such as the so-called sandy zone where many black spots appear on a white background sometimes occur.

The discharge amount may be determined by predicting in advance the unevenness of contamination of the charging roller and film thickness unevenness of the photosensitive drum, but such phenomena greatly vary depending on the mode of use by the user, and are therefore difficult to predict.

Accordingly, it is an objective of the present invention to provide an image forming apparatus, a process cartridge, and an image forming method capable of detecting discharge unevenness in the longitudinal direction and optimizing the discharge amount.

In order to achieve the object described above, an image forming apparatus comprises:

a rotatable image bearing member that bears a latent image;

an exposure unit for exposing the image bearing member;

a charging member that charges the image bearing member;

a bias applying unit for applying a bias voltage to the charging member;

a discharge amount detection unit for detecting a current amount discharged between the charging member and the image bearing member;

a discharge current control unit for determining a bias voltage to be applied to the charging member from the discharge current amount detected by the discharge amount detection unit; and a discharge information detection unit for detecting discharge information which is information on discharge between the charging member and the image bearing member, wherein the discharge information detection unit sets, in a part of a printable region on the surface of the image bearing member, a region, which has a width in a direction perpendicular to the rotation direction that is less than a width of the printable region, as a partial measurement region, and detects partial discharge information on discharge between the partial measurement region and the charging member when the exposure unit forms different potentials in the partial measurement region and a region excluding the partial measurement region after the image bearing member is charged to a constant potential by the charging member, and the discharge current control unit corrects the bias voltage in image formation that is applied to the charging member on the basis of the partial discharge information.

As described above, according to the present invention, it is possible to detect the discharge unevenness in the longitudinal direction and optimize the discharge amount.

Further features of the present invention will become apparent from the following description of exemplary embodiments with reference to the attached drawings.

BRIEF DESCRIPTION OF THE DRAWINGS

FIGS. 11A, 11B and 11C are longitudinal schematic diagrams illustrating a photosensitive drum potential according to Example 1;

DESCRIPTION OF THE EMBODIMENTS

The exemplary embodiments for carrying out the present invention will be described hereinbelow on the basis of examples thereof with reference to the accompanying drawings. However, for example, the dimensions, materials, shape and mutual arrangement of constituent components described in the embodiments should be appropriately changed according to the configuration of the device to which the invention is applied and various conditions. Thus, the scope of the present invention is not intended to be limited to the following embodiments.

Example 1

In the present example, a plurality of types of partial discharge information in the longitudinal direction is detected in the longitudinal direction in a configuration in which the bias voltage applied to the charging member is controlled so that the discharge current flowing between the charging member and the image bearing member is kept constant. The discharge amount is then optimized by correcting the bias voltage output value on the basis of these values.

A process cartridge and an image forming apparatus according to the present invention will be described hereinbelow by taking an electrophotographic method as an example.

<Outline of Configuration and Operation of Image Forming Apparatus and Process Cartridge>

Figure 2:
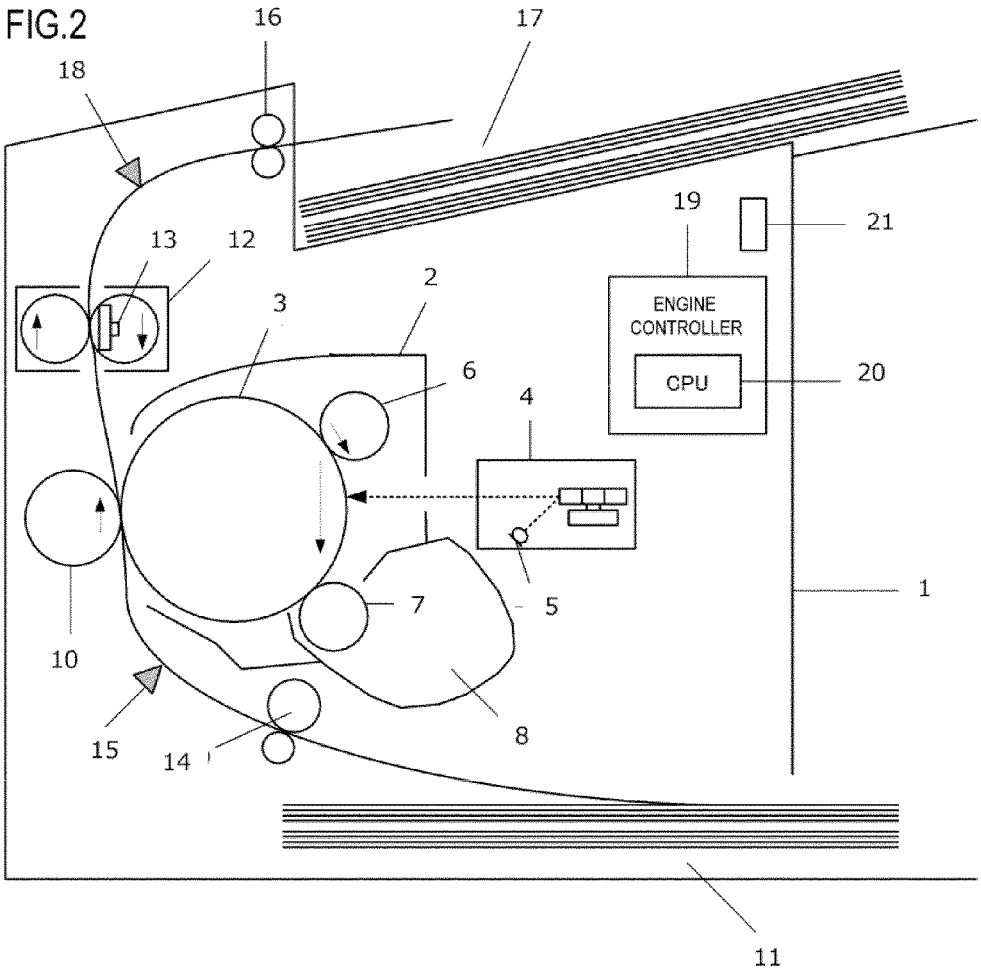
FIG. 2 is a schematic diagram illustrating an image forming apparatus according to Example 1.

FIG. 2 is a schematic view of an image forming apparatus 1 on which a process cartridge has been mounted. The reference numeral 3 denotes a photosensitive drum which is a rotatable image bearing member, and the reference numeral 4 denotes a laser scanner which is exposure unit for scanning a laser beam over the photosensitive drum 3 with a semiconductor laser 5 to form an electrostatic latent image. The reference numeral 2 denotes a replaceable process cartridge. The process cartridge 2 is configured of a charging roller 6 which is a charging member for uniformly charging the photosensitive drum 3, a developer carrying member 7 which develops, with a developer, the electrostatic latent image formed by the laser scanner 4 on the photosensitive drum 3, and a developing device 8 that stores the developer. The reference numeral 10 denotes a transfer roller for transferring the developer image developed on the photosensitive drum 3 to a predetermined recording material 11, the reference numeral 12 denotes a fixing device for fixing with heat and pressure the developer transferred to the recording material 11, and the reference numeral 13 denotes a temperature thermistor for controlling the temperature of the fixing device. The reference numeral 14 denotes a paper feed roller for feeding the recording material. The reference numeral 15 denotes a top sensor for synchronizing with the conveyance of the recording material, the reference numeral 16 denotes a paper discharge roller for discharging the recording material 11 after fixing to a discharge tray 17, and the reference numeral 18 denotes a paper discharge sensor for detecting the presence or absence of the recording material 11 after fixing. The reference numeral 19 denotes an engine controller including a CPU 20 and controlling each part constituting the image forming apparatus 1. The reference numeral 21 denotes an environment sensor for detecting the external environment of the image forming apparatus 1.

Further, in the present example, an environment of 23° C. and 50% RH is used and the conditions include a resolution of 600 dpi, a process speed of 235 mm/sec, and an exposure amount of 0.2 $\mu J/cm^2$. In the present example, a negative polarity toner is used, but a positive polarity toner may be also used. In this case, the configuration is the same as that when the negative polarity toner is used, except that the signs of bias, etc., are all reversed.

<Control of Charging Portion>

Figure 3:
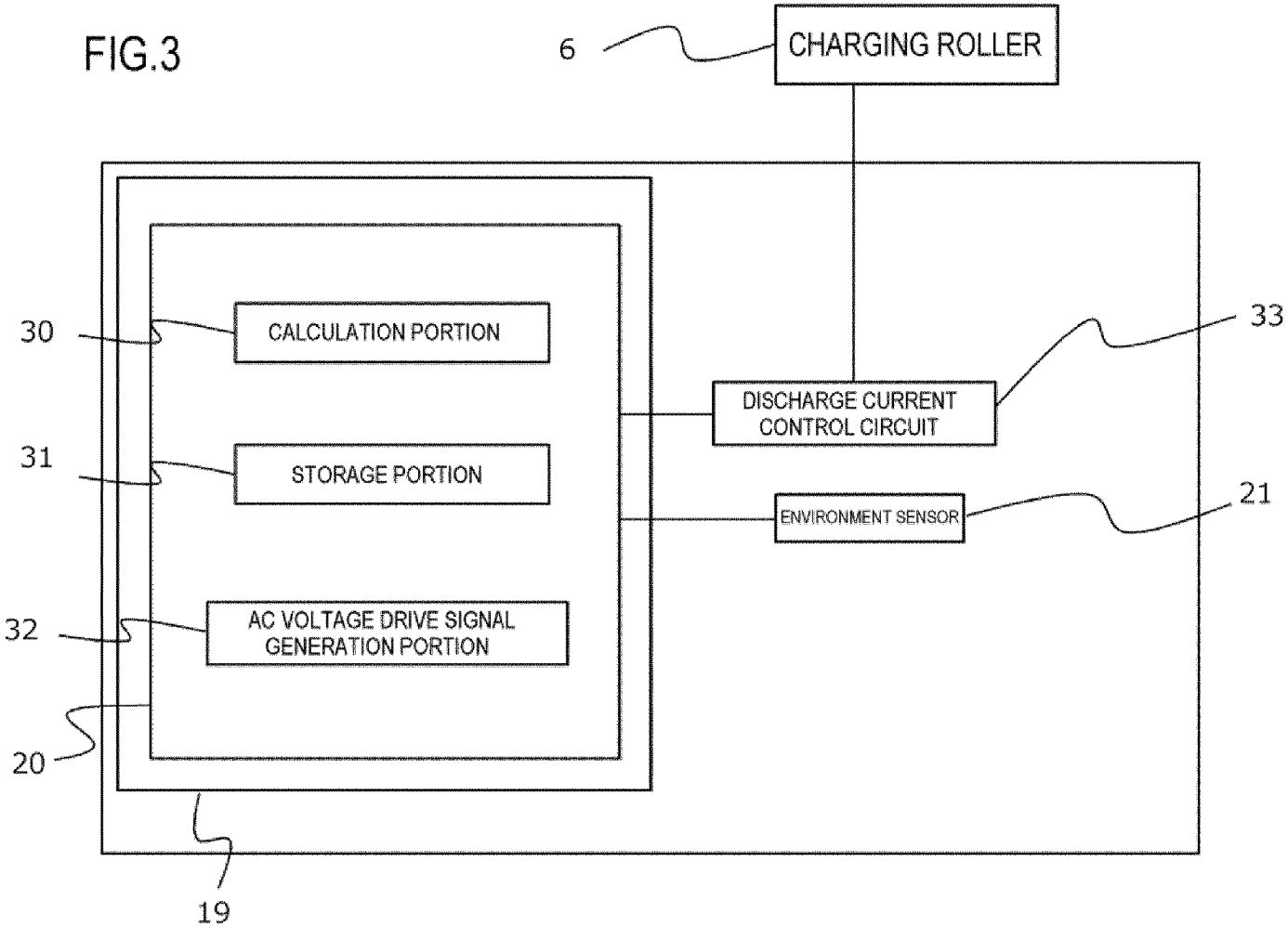
FIG. 3 is a discharge current control block diagram according to Example 1.

Next, a block diagram for controlling the charging portion of the image forming apparatus in the present example is shown in FIG. 3. The CPU 20 includes a calculation portion 30, a storage portion 31, and an AC voltage drive signal generation portion 32. Inside the discharge current control circuit (bias applying unit) 33, a voltage is applied to the charging roller 6 while controlling the discharge current by transmitting a signal from the CPU 20. Here, the discharge control unit includes the CPU 20 and the discharge current control circuit 33. Further, the CPU 20 detects the output value of the environment sensor 21 and controls the discharge current corresponding to the output value. The detailed operation of the discharge current control circuit 33 will be described below.

<Discharge Current Control>

Figure 4:
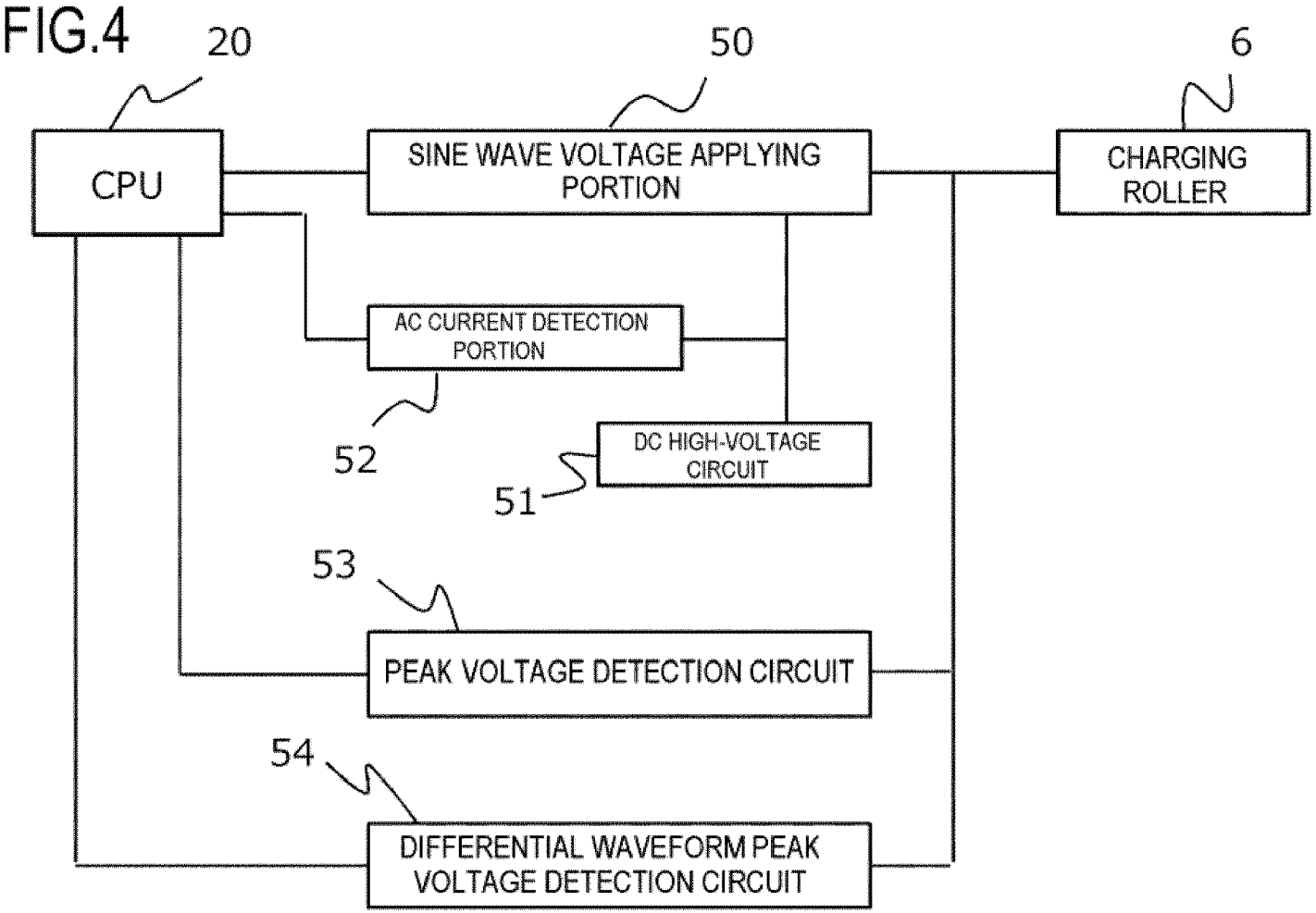
FIG. 4 is a discharge current control circuit diagram according to Example 1.

The discharge current control circuit 33 in the present example is shown in FIG. 4. The AC high voltage of the sine wave generated by a sine wave voltage applying portion 50 is superimposed on the DC voltage outputted by a DC high-voltage circuit 51. This oscillating voltage is supplied to the charging roller 6. The AC current value is controlled so as to have a constant oscillating voltage output level in accordance with the detection output value of an AC current detection portion 52 as AC current value detection unit. Further, the discharge current control circuit 33 has a peak voltage detection circuit 53 which is a voltage amplitude value detection portion and a differential waveform peak voltage detection circuit 54 which is a differential amplitude value detection portion. As a result, the CPU 20 can detect the peak value of the AC voltage to be outputted and the differential waveform peak value. Here, the discharge amount detection unit includes the peak voltage detection circuit 53, the differential waveform peak voltage detection circuit 54, and the CPU 20.

Figure 5:
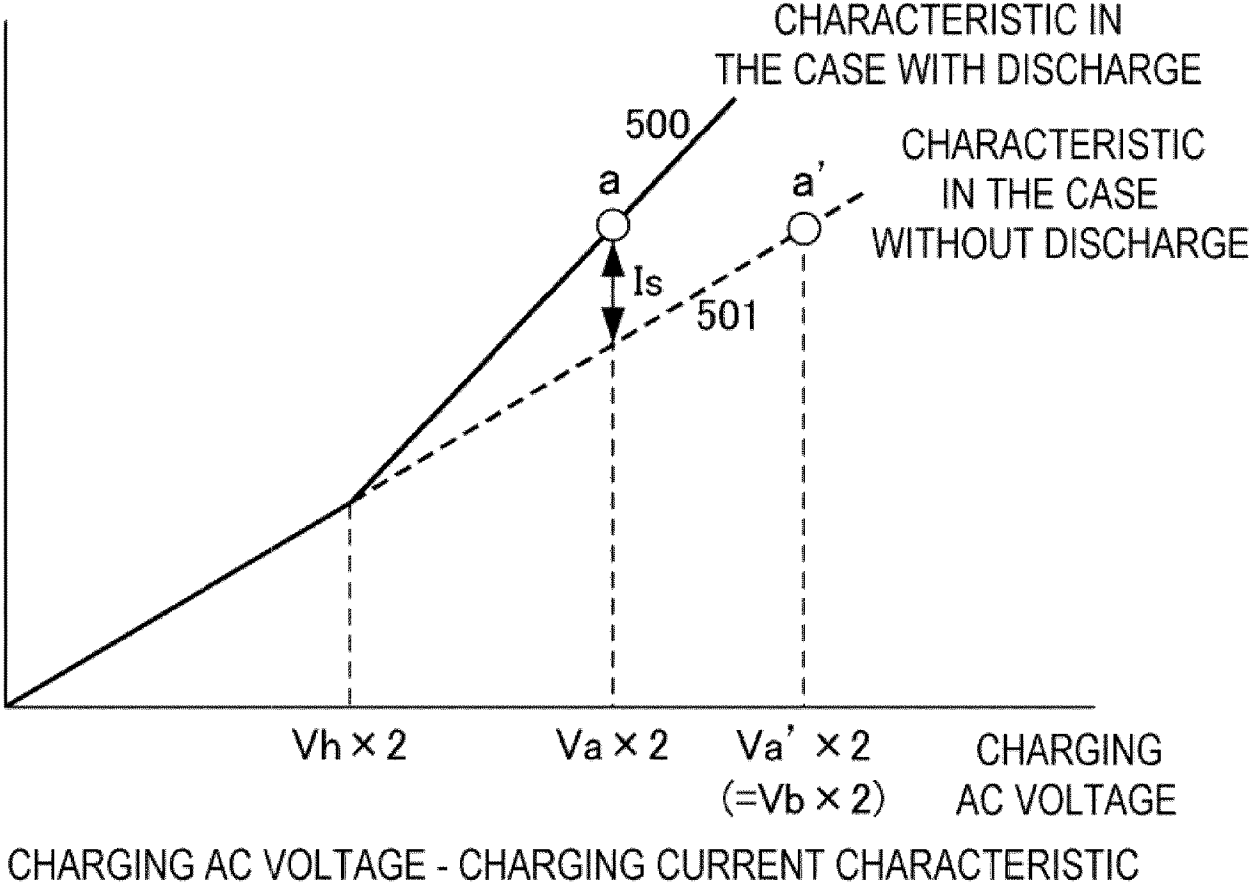
FIG. 5 is a diagram illustrating a discharge current detection method according to Example 1.

A method for detecting the discharge current in the present example will be described with reference to FIG. 5. FIG. 5 shows the charging current flowing through the charging roller 6 when an AC voltage is applied to the charging roller 6. The value of the peak voltage of the AC voltage is plotted against the abscissa, and the effective value of the AC current is plotted against the ordinate. As shown in FIG. 5, in a region where the charging AC voltage is not more than twice the discharge starting voltage (Vh), the relationship between the charging current value and the charging AC voltage is represented by a substantially proportional straight line passing through the origin. In this region, the flowing current corresponds to the resistive load and capacitive load between the charging roller 6 and the photosensitive drum 3. In contrast, in a region where the charging AC voltage is at least twice the discharge starting voltage (Vh), a discharge current is generated between the charging roller 6 and the photosensitive drum 3, and the charging current value Ic increases by the discharge current value. In the discharge starting region, the characteristic in the case of discharge is represented by 500, and the characteristic in the case without discharge is represented by 501. Here, the discharge current value can be calculated from the relationship between the characteristic 500 and the characteristic 501. Further, the discharge current value Is can be obtained from the following Equation (1).

$$Is = Ic \times (Va' - Va)/Va' \quad \text{Equation (1)}$$

where Va is the peak value in the case of discharge, Va' is the peak value in the case without discharge, and Ic is a discharge current.

Figure 6A:
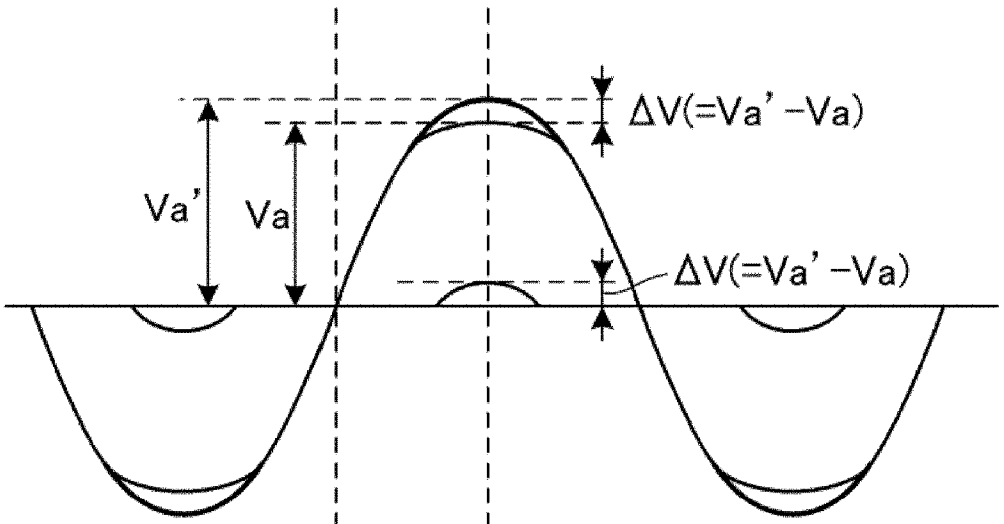
FIGS. 6A and 6B are diagrams illustrating waveforms detected by a discharge current control circuit according to Example 1.
Figure 6B:
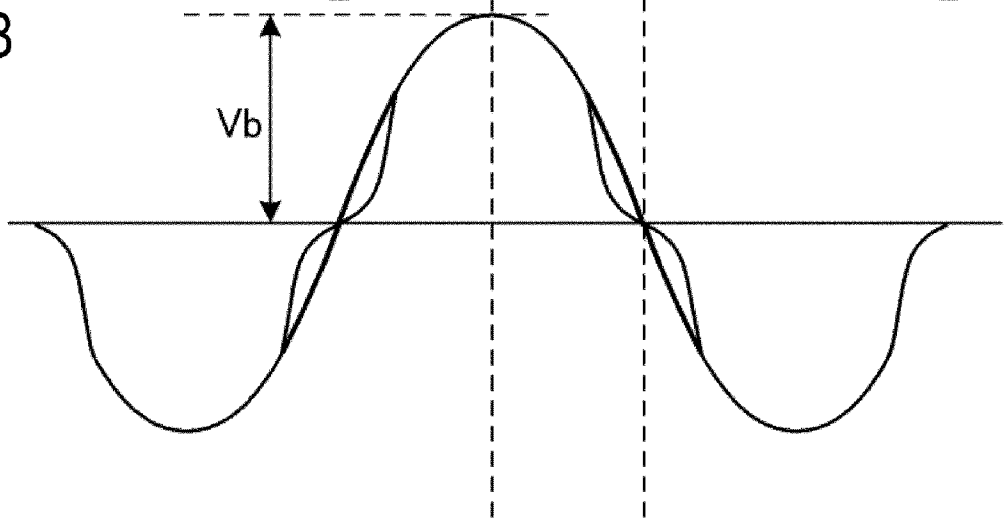

Thus, where (Va'−Va)/Va' is known, the discharge amount related to the charging current can be detected. How to obtain (Va'−Va)/Va' will be explained with reference to FIGS. 6A and 6B. FIG. 6A shows the charging AC voltage output waveform applied to the charging roller 6, and FIG. 6B shows the differentiated waveform of the charging AC voltage output. The output waveform of the charging AC voltage has a shape in which the level near the peak is decreased by ΔV (=(Va'−Va)) under the influence of discharge. Further, since the phase of the differential voltage waveform is delayed by 90°, the peak value is not affected by the discharge. Thus, the peak value (Vb) of the differential voltage corresponds to the peak level (Va') of the output voltage in the case without discharge. Therefore, (Va'−Va)/Va' can be obtained. The discharge current value Is is detected by the method illustrated by FIGS. 5 to 6B, and the charging current value Ic is adjusted so that the discharge current value Is is a desired value.

In the present example, in order to solve the problem of discharge unevenness in the longitudinal direction, in addition to the above-described discharge current control, the discharge amount was optimized by detecting discharge information on a portion in the longitudinal direction (referred to hereinbelow as partial discharge information) and correcting the output value of a charging bias on the basis of these values. Further, in the present example, a discharge starting voltage relating to a portion (referred to hereinbelow as a partial discharge starting voltage) was measured as the partial discharge information.

Initially, the discharge starting voltage detection necessary for detecting the partial discharge starting voltage as the partial discharge information and a method for performing uniform charging will be described, and then a method for detecting the partial discharge starting voltage as the partial discharge information will be described.

<Discharge Starting Voltage Detection>

Figure 7:
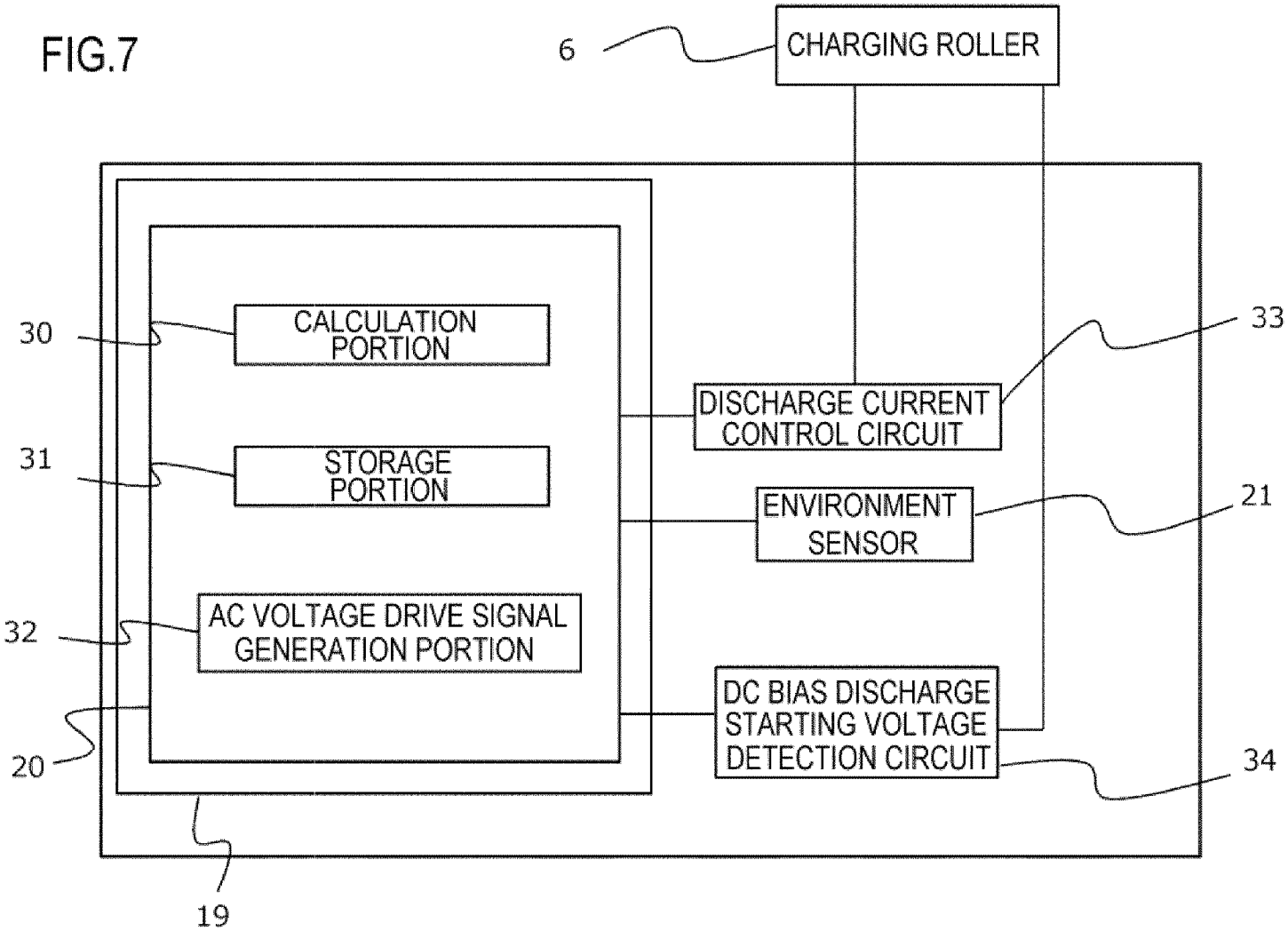
FIG. 7 is a DC bias discharge starting voltage detection block diagram according to Example 1.
Figure 8:
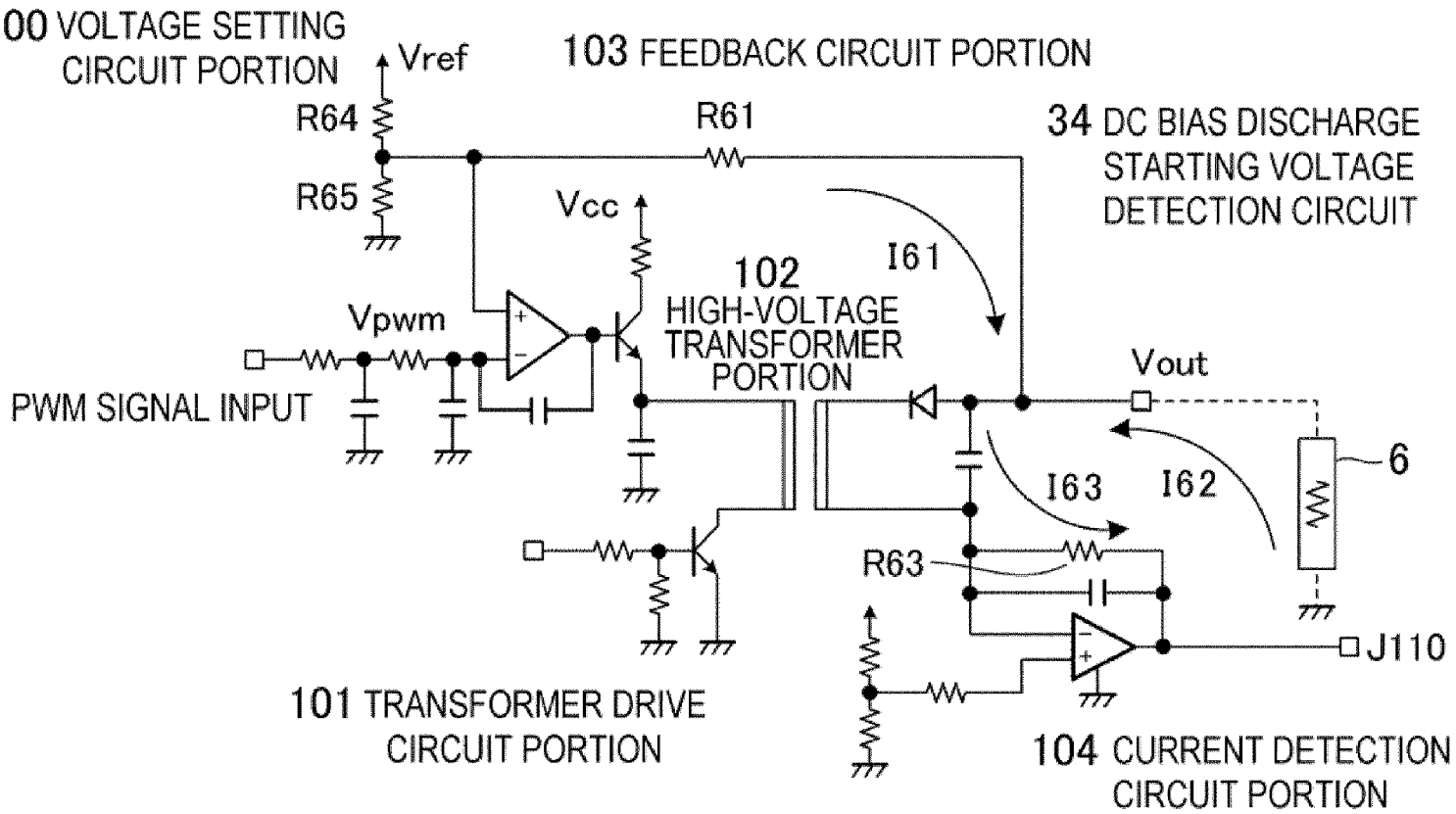
FIG. 8 is a DC bias discharge starting voltage detection circuit diagram according to Example 1.

In order to detect the partial discharge information in the longitudinal direction, in the present example, as shown in FIG. 7, a DC bias discharge starting voltage detection circuit (discharge information detection unit) 34 is provided. The DC bias discharge starting voltage detection circuit 34 detects a discharge starting voltage while applying a DC voltage to the charging roller 6 by receiving a signal transmitted from the CPU 20. FIG. 8 shows a schematic configuration of the DC bias discharge starting voltage detection circuit 34 in the present invention. The reference numeral 100 denotes a voltage setting circuit portion in which a bias value is changed according to a PWM signal. The reference numeral 101 denotes a transformer drive circuit portion, and the reference numeral 102 denotes a high-voltage transformer portion. The reference numeral 103 denotes a feedback circuit portion which monitors the output voltage through R61 and is a circuit provided so as to obtain an output voltage value corresponding to the setting of the PWM signal. The reference numeral 104 denotes a current detection circuit portion (current detection unit) which detects, at R63, a current value I63 obtained by adding up a current value I62 flowing through the charging roller 6 and a current value I61 flowing from the feedback circuit and transmits the detected value as an analog value from J110 to the CPU 20. The photosensitive drum 3 and the charging roller 6 are insulated from each other until a discharge starts between the photosensitive drum 3 and the charging roller 6. Therefore, until the discharge is started, the current flowing through the detection resistor R63 is only I61 flowing from the feedback circuit portion 103. I61 is determined by Vpwm, which is set by the PWM signal, and also Vref, R64, and R65. I61=(Vref−Vpwm)/R64−Vpwm/R65.

Further, the current value I61 flows through the feedback resistor R61, whereby the output voltage Vout is also set as follows. Vout=I61×R61+Vpwm≅I61×R61.

Figure 9:
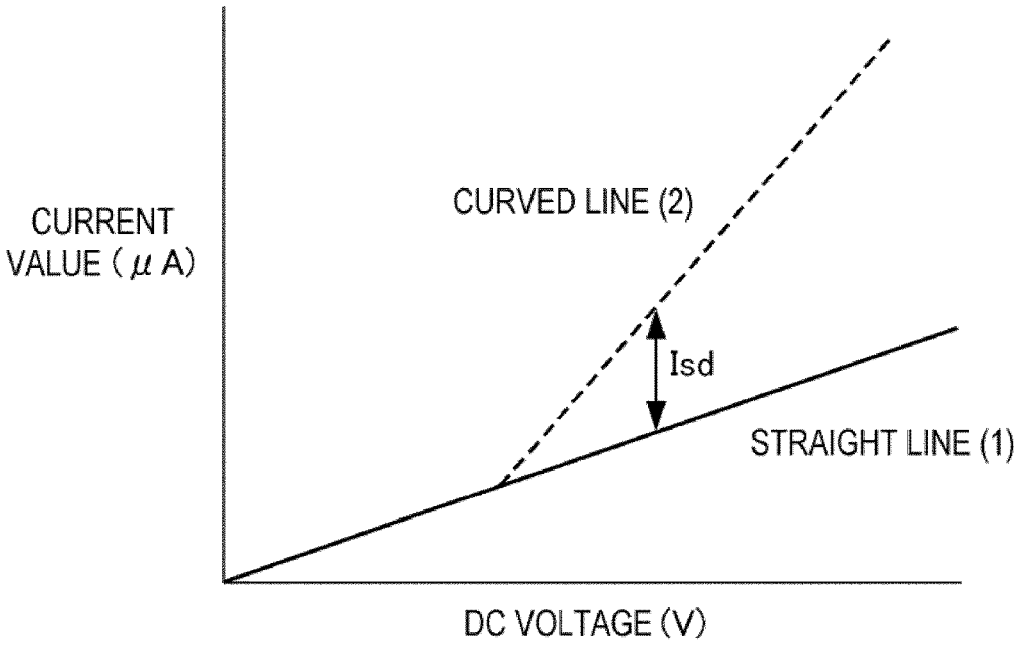
FIG. 9 is a schematic diagram of a V-I characteristic at the time of DC charging bias application according to Example 1.

In other words, as indicated by the straight line (1) in FIG. 9, since only the current value I61 corresponding to the PWM signal flows through R63 of the current detection circuit portion until the discharge starts, the current value is a straight line.

However, when a discharge starts between the photosensitive drum 3 and the charging roller 6, the current value I63 obtained by adding up the current value I62 flowing through the charging roller 6 and the current value I61 flowing from the feedback circuit flows in R63 of the current detection circuit portion. In other words, the current value becomes a curve having a branch point at a point of time at which the discharge starts, as shown by a curve (2) in FIG. 9. From this, the current flowing through the charging roller 6 can be calculated by Isd obtained by subtracting the straight line (1) from the curve (2).

Figure 10:
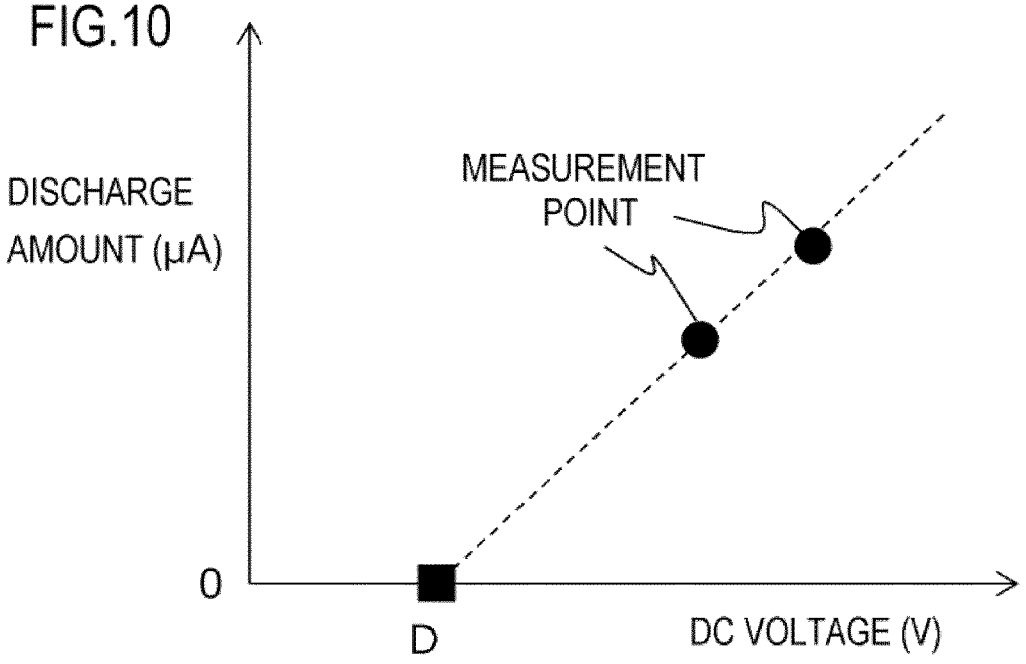
FIG. 10 is a schematic diagram illustrating a discharge starting voltage detection method according to Example 1.

In the present example, a plurality of Isd was measured while manipulating the DC bias, and a point of time at which a certain Isd reached a predetermined current value was determined as a DC bias discharge starting voltage. However, a method for determining the DC bias discharge starting voltage is not limited to this method. For example, as shown in FIG. 10, a method may be used by which discharge amounts relating to two different DC biases are measured, an approximate straight line is drawn therethrough, and a point (D in FIG. 10) at the straight line where the discharge amount is 0 is determined as a DC bias discharge starting voltage. From the viewpoint of accuracy, the number of measuring points is not limited to two and may be increased.

<Method for Performing Charging Uniformly in the Longitudinal Direction>

Next, a method for performing charging uniformly in the longitudinal direction will be described. In order to detect the partial discharge starting voltage in the longitudinal direction, it is necessary to charge the photosensitive drum 3 uniformly in the longitudinal direction, that is, to a constant potential. Since the DC bias discharge starting voltage varies depending on the potential of the charging roller 6, the discharge unevenness cannot be detected from the DC bias discharge starting voltage unless the potential is uniform in the longitudinal direction. In order to charge uniformly in the longitudinal direction, a sufficient charging AC voltage needs to be applied. In the present example, the maximum value of the charging AC bias in the present configuration is applied. Further, a mechanism may be provided for confirming whether the charging potential is uniform at that time.

A mechanism for confirming a uniform charging potential will be described below. First, a predetermined DC bias and a maximum AC bias are applied, and a DC bias discharge starting voltage Vdcth1(ave) in the entire longitudinal direction at that time is detected with the DC bias discharge starting voltage detection circuit 34. Next, the AC bias (PWM) is stepped down by one step, the predetermined DC bias and the AC bias are similarly applied, and a DC bias discharge starting voltage Vdcth2(ave) in the entire longitudinal direction at that time is detected with the DC bias discharge starting voltage detection circuit 34. At this time, the DC bias discharge starting voltages in the entire longitudinal direction can be written as Vdcth1(ave)=(1+C/Cd)Vpa+Vd1(ave), Vdcth2(ave)=(1+C/Cd)Vpa+Vd2(ave). Here, the electrostatic capacity of the photosensitive drum 3 is denoted by Cd, and the electrostatic capacity between the charging roller 6 and the photosensitive drum 3 is denoted by C.

Then, a relational expression of Vdcth1(ave)−Vdcth2(ave)=Vd1(ave)−Vd2(ave) is obtained. Here, Vd1(ave) is the average potential in the longitudinal direction of the photosensitive drum 3 charged with the maximum AC bias, and Vd2(ave) is the average potential in the longitudinal direction of the photosensitive drum 3 charged with the AC bias with a set value which was stepped down by one step from the maximum. Vpa is a Paschen voltage which is a function of air pressure and gap distance.

FIGS. 11A to 11C show the relationship between the potential in the longitudinal direction of the photosensitive drum 3 and the AC bias. Vac1, Vac2, and Vac3 each are a peak-to-peak value of the AC bias applied to the charging roller 6, and Vac1<Vac2<Vac3. Charging with AC bias stabilizes at a constant charging potential by repeating positive discharge and reverse discharge, but when the AC bias is low, the charging potential becomes uneven in the longitudinal direction in the case where the discharge is uneven in the longitudinal direction (FIG. 11A). However, where the AC bias is raised, the discharge amount increases over the entire longitudinal direction, and the charging potential of the photosensitive drum 3 becomes uniform (FIG. 11B). The average potential rises accordingly. When the AC bias is further raised and the charging potential becomes uniform over the entire longitudinal direction, the average potential remains at a constant value (FIG. 11C).

It follows from above that the uniformity of the charging potential of the photosensitive drum 3 can be confirmed by comparing Vdcth1(ave) and Vdcth2(ave). Specifically, where Vdcth1=Vdcth2, it can be determined that Vd1=Vd2 and the charging potential in the longitudinal direction is uniform. Conversely, where Vdcth1≠Vdcth2, Vd1≠Vd2 and it is determined that charging is not sufficient. In this case, since it is impossible to provide an image of stable quality at any voltage, it is necessary to take measures, for example, to notify the user of the process cartridge life.

In the present example, the maximum AC bias is applied as the charging bias. However, this feature is not limiting, and a bias capable of sufficiently uniform charging may be clarified in advance by examination and the value thereof may be used.

<Detection of Partial Discharge Information>

Detection of partial discharge starting voltage as partial discharge information in the longitudinal direction will be described with reference to FIGS. 12A to 12C. The horizontal direction in FIGS. 12A to 12C represents the position in the longitudinal direction, and the vertical direction represents the potential.

Figure 12A:
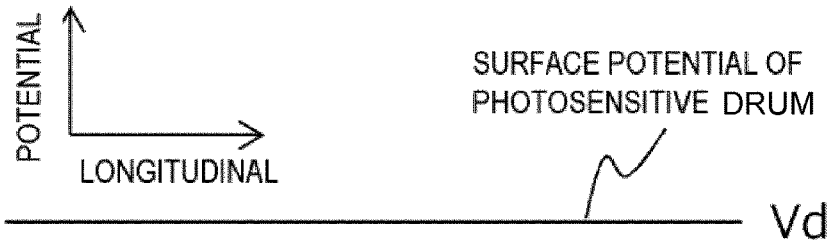
FIGS. 12A, 12B and 12C are schematic diagrams illustrating partial discharge starting voltage measurement according to Example 1.
Figure 12B:
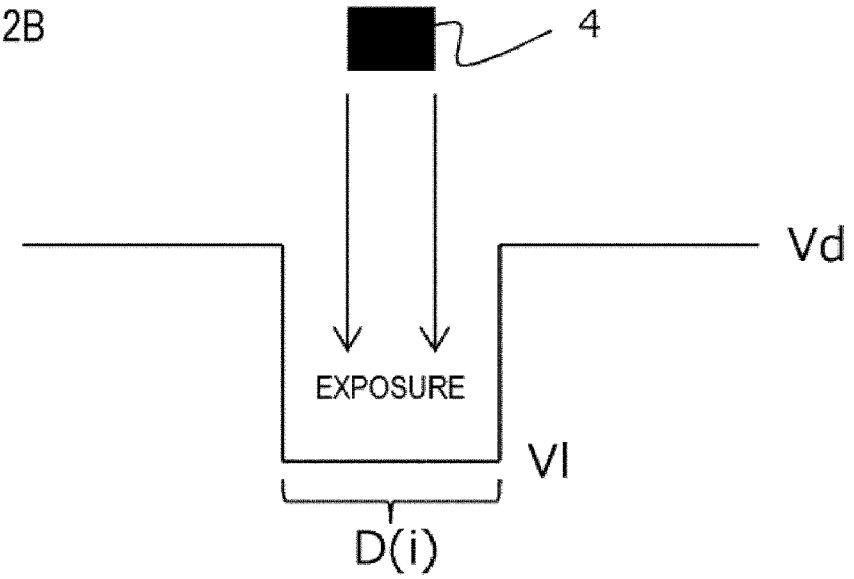
Figure 12C:
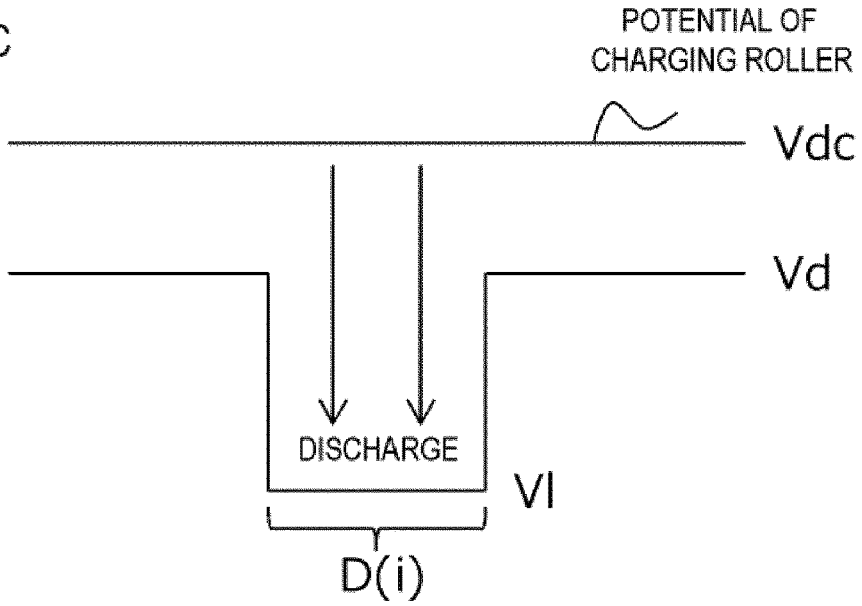

First, as shown in FIG. 12A, the maximum AC bias is applied as described above to charge uniformly the photosensitive drum 3 (charging potential: Vd). Next, as shown in FIG. 12B, a measurement region (referred to hereinbelow as partial measurement region) D(i) which has a width in the longitudinal direction smaller than that of a printable region is set in a part of the printable region of the photosensitive drum 3, and only the partial measurement region D(i) is exposed by the laser scanner 4 to an exposure potential (Vl). The partial measurement region may be provided in a plurality of places in the longitudinal direction. In this case, different potentials are set in the partial measurement region D(i) exposed by the laser scanner 4 and the region excluding the partial measurement region. Further, as shown in FIG. 12C, a DC bias (Vdc) is applied to the charging roller 6 by using the DC bias discharge starting voltage detection circuit 34, and the DC bias discharge starting voltage is measured in a state at a partial exposure potential. At this time, since only the partial measurement region D(i) starts to discharge, the DC bias partial discharge starting voltage Vdcth(i) of the partial measurement region D(i) is obtained. Let us consider an equivalent circuit by taking the electrostatic capacitance of the photosensitive drum in the partial measurement region D(i) as Cd(i) and the electrostatic capacitance between the charging roller 6 and the photosensitive drum 3 as C(i). In this case, the value of the DC bias partial discharge starting voltage is Vdcth(i)=(1+C(i)/Cd(i))Vpa+|Vl|.

Further, when actually forming an image, a DC+AC bias is applied, but the AC bias partial discharge starting voltage Vacth(i) of the partial measurement region D(i) at that time can be written as Vacth(i)=2Vpa(1+C(i)/Cd(i)). Here, the AC bias partial discharge starting voltage is a voltage at which a reverse discharge from the photosensitive drum 3 to the charging roller 6 is started and the convergence to the DC bias is started, rather than a voltage at which the partial measurement region D(i) starts to discharge from the charging roller 6 to the photosensitive drum 3. Further, the AC bias partial discharge starting voltage is a peak-to-peak value of the AC bias. Therefore, the relational expression of Equation (2) is satisfied.

$$\mathrm{Vacth}(i)=2(\mathrm{Vdcth}(i)-|Vl|) \qquad \text{Equation (2)}$$

Equation (3) can be obtained from this relational expression by assuming that the DC bias discharge starting voltage over the entire longitudinal direction is Vdcth(ave) and the AC bias discharge starting voltage over the entire longitudinal direction is Vacth(ave).

$$V\mathrm{acth}(i)-V\mathrm{acth}(\mathrm{ave})=2(V\mathrm{dcth}(i)-V\mathrm{dcth}(\mathrm{ave})) \qquad (3)$$

The AC bias partial discharge starting voltage of the partial measurement region D(i) can be detected with this Equation (3). Actually, correction is performed using this AC bias partial discharge starting voltage difference Vacth (i)−Vacth(ave). Here, Vdcth(ave) is actually used by finding the DC bias discharge starting voltage over the entire longitudinal direction from the detection of the DC bias discharge starting voltage. However, such an approach is not limiting, and the average value of Vdcht(1), Vdcth(2) . . . Vdcht(N) may be also determined and used.

Figure 13A:
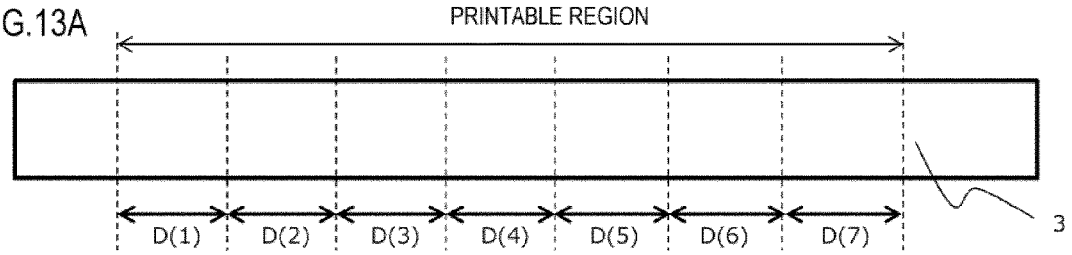
FIGS. 13A and 13B are schematic diagrams illustrating a measurement region according to Example 1.
Figure 13B:
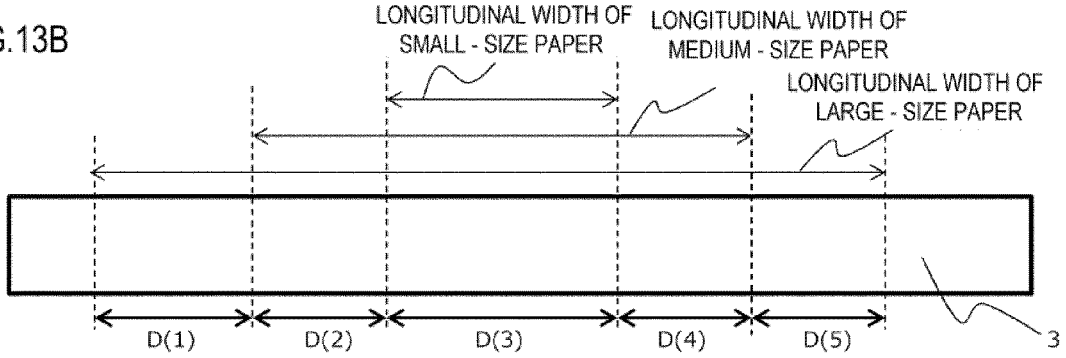

Next, a partial measurement region for detecting partial discharge starting voltage will be described. FIG. 13A shows the partial measurement region of the present example. The horizontal direction in FIGS. 13A and 13B indicates the longitudinal direction (the direction perpendicular to the rotation direction) of the photosensitive drum 3. In the present example, the longitudinal direction of the printable region in the surface of the photosensitive drum 3 is divided into seven equal regions, and the partial discharge starting voltage is detected in each region. However, this method for setting the partial measurement region is not limiting, and the division into unequal regions may be also performed. Further, as shown in FIG. 13B, the partial measurement region may be determined according to the size of the paper. In this case, since measurement can be performed by taking into consideration the scraping of the photosensitive drum 3, accuracy is improved. Furthermore, the usage history of the paper may be stored in the CPU 20, or the like, and the partial measurement region may be changed, or the like, according to the usage history of the paper.

Further, in the case where a region in which the discharge starting voltage will increase is established in advance from prediction of scraping of the photosensitive drum 3 or prediction of contamination of the charging roller 6, it is effective to measure the partial discharge starting voltage only in that region. In this case, it is necessary to obtain the total DC bias discharge amount starting voltage Vdcth(ave) from the discharge starting voltage detection unit which targets the entire longitudinal direction.

<Correction Method>

A method for correcting the charging bias output value from the AC bias partial discharge starting voltage will be described hereinbelow.

Figure 14A:
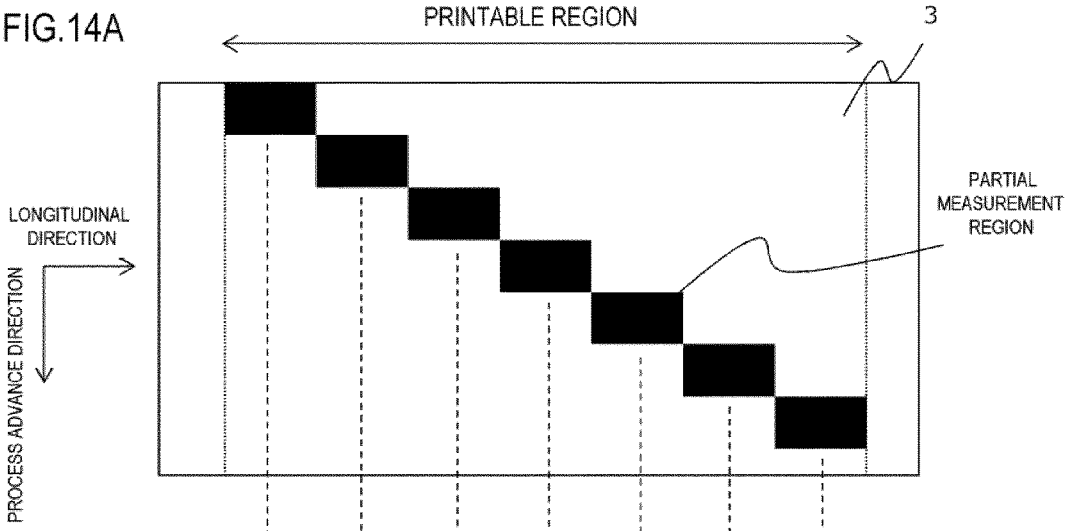
FIGS. 14A and 14B are schematic diagrams illustrating a detection of a plurality of the AC bias discharge starting voltage value differences in the longitudinal direction according to Example 1.
Figure 14B:
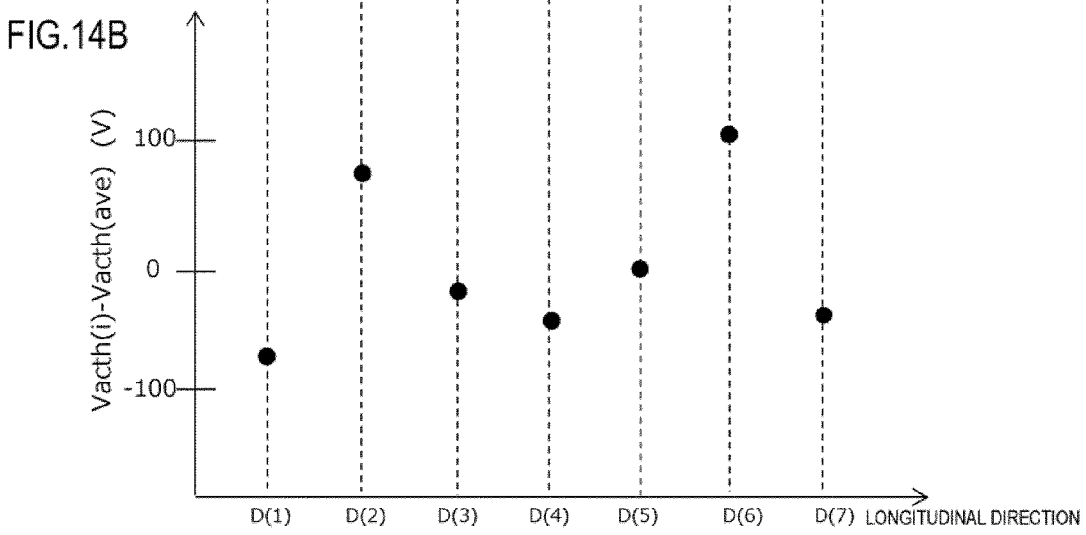
Figure 15:
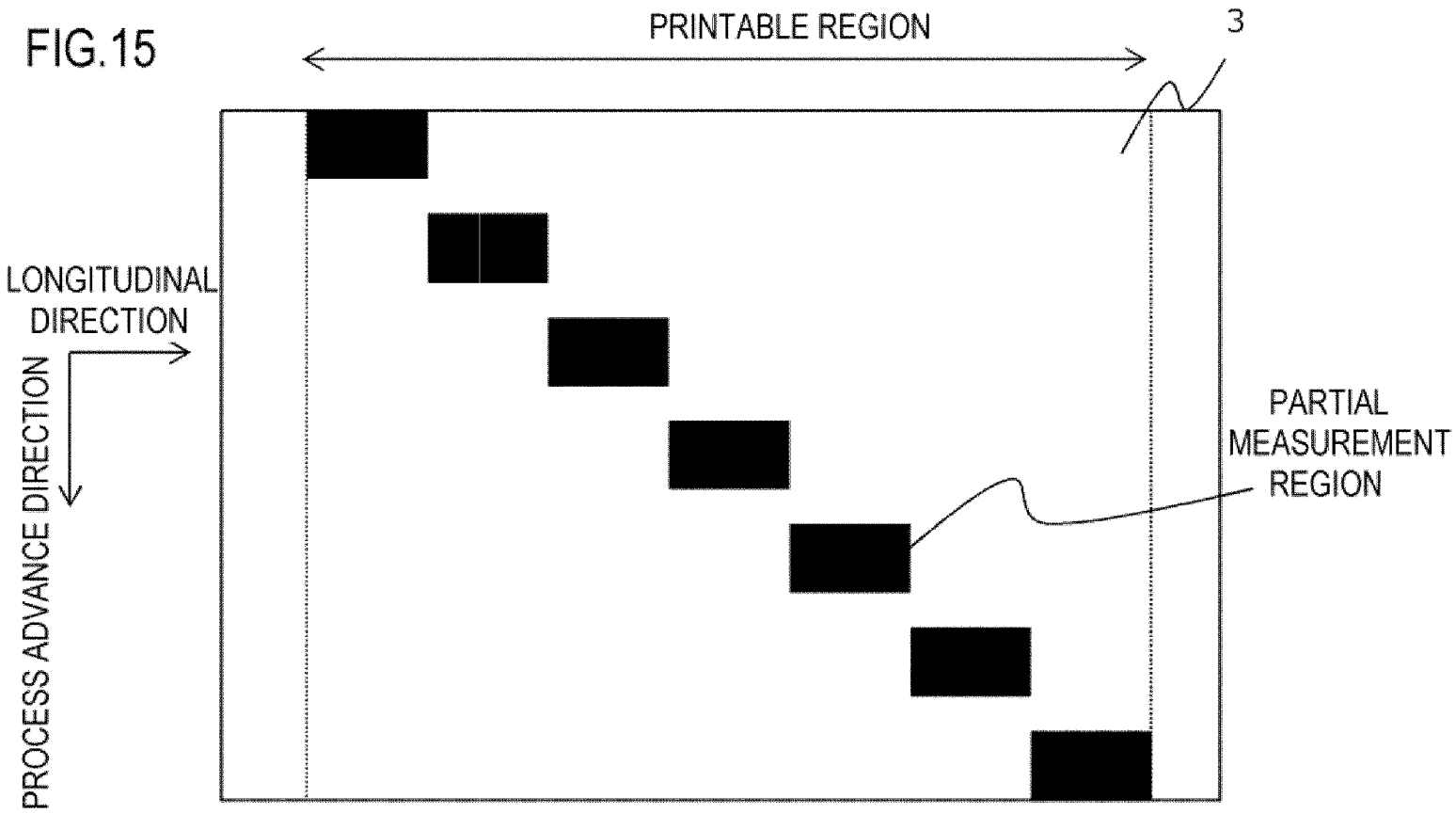
FIG. 15 is a schematic diagram illustrating a detection of a plurality of the AC bias discharge starting voltage value differences in the longitudinal direction according to Example 1.

In FIG. 14A, the horizontal axis is the longitudinal direction, and the vertical axis is the image forming process advance direction. This figure represents the partial measurement region of the photosensitive drum 3. In the present example, as shown in FIG. 14A, the partial discharge starting voltage was sequentially detected from D(1). However, this method is not limiting. For example, the order of measurement may be changed, or there may be an interval in the detection of the partial measurement region as shown in FIG. 15. FIG. 14B shows the difference between the AC bias partial discharge starting voltage and the AC bias discharge starting voltage in the entire longitudinal direction in each partial measurement region. The region with the largest difference Vacth(i)−Vacth(ave) is the portion where the discharge is most unlikely to proceed, and the region with the smallest difference is the portion where the discharge is most likely to proceed. In the detection result shown in FIG. 14B, D(6) is the portion where the discharge is most unlikely to proceed and D(1) is the portion where the discharge is most likely to proceed. Correction is made from the AC bias partial discharge starting voltage in the partial measurement region obtained hereinabove.

Figure 16A:
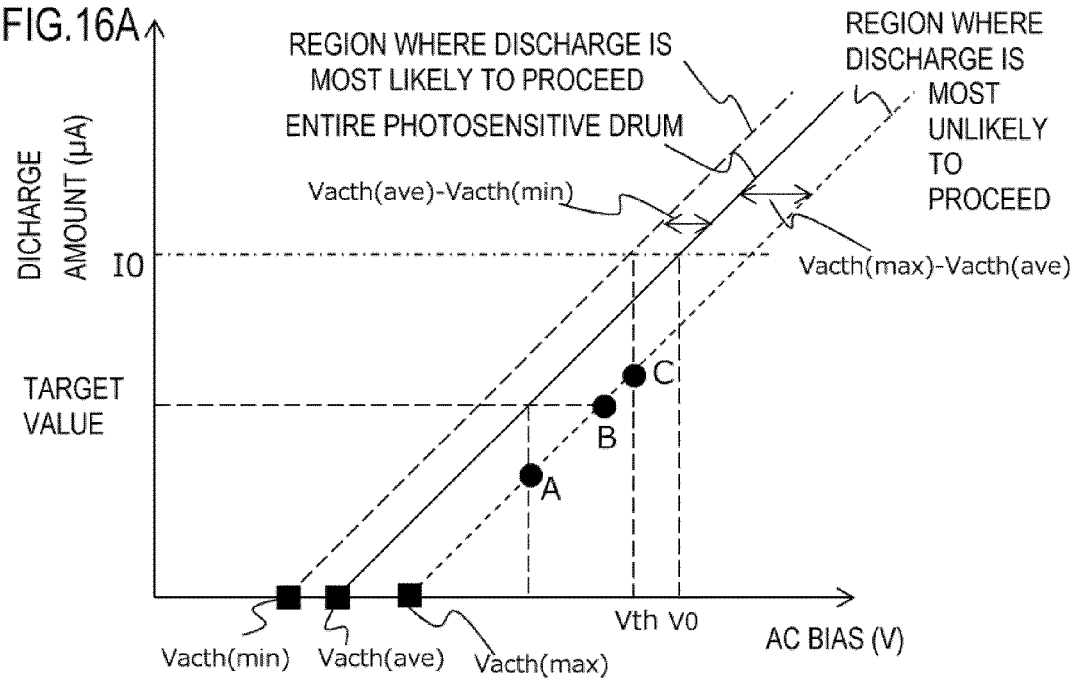
FIGS. 16A and 16B are graphs showing the relationship between a discharge amount and an AC bias according to Example 1.
Figure 16B:
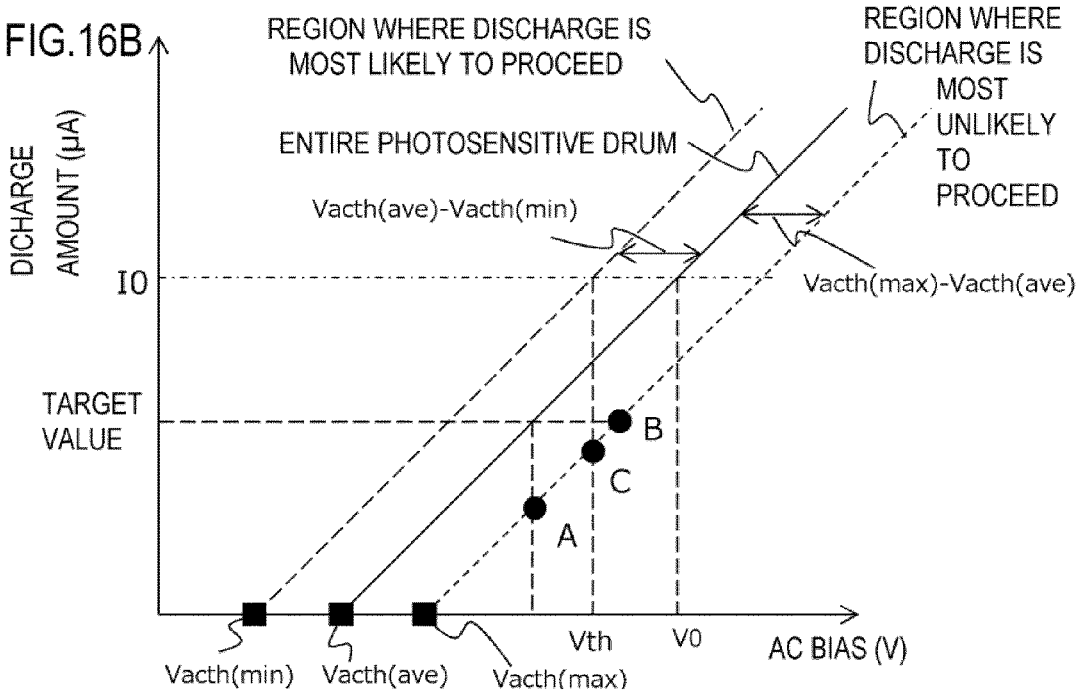

FIGS. 16A and 16B show the relationship between the discharge amount and the AC bias. In FIGS. 16A and 16B, the relationship between the discharge amount of the entire photosensitive drum 3 and the AC bias is indicated by a solid line. The relationship between the discharge amount of the region of the photosensitive drum 3 where the discharge is most likely to proceed (D(1) in the example shown in FIG. 14B) and the AC bias is shown by a coarse broken line. Further, the relationship between the discharge amount of the region of the photosensitive drum 3 where the discharge is most unlikely to proceed (D(6) in the example shown in FIG. 14B) and the AC bias is shown by a fine broken line. The AC bias is the peak-to-peak voltage value. As shown in FIGS. 16A and 16B, in the portion where the discharge is most unlikely to proceed, the discharge characteristic shifts by the discharge starting voltage difference. For this reason, even though the total discharge amount has reached the target discharge amount, the discharge amount in the portion where the discharge is most unlikely to proceed has not reached the target discharge amount (A in FIGS. 16A and 16B). In FIG. 16A, the AC bias at the intersection of the broken line that passes through the target value on the ordinate and is parallel to the abscissa and the graph represented by the solid line indicates the AC bias in the case in which the total discharge amount of the photosensitive drum 3 is the target value. The intersection A of the broken line passing through the above intersection and parallel to the ordinate and the fine broken line indicates the discharge amount in the region where the discharge is most unlikely to proceed when the value of the applied AC bias is such that the total discharge amount of the photosensitive drum 3 becomes the target value. The discharge amount in this case is less than the target value as can be seen from FIG. 16A. In such a case, the sandy zone may be generated as described in the abovementioned problem.

Further, as shown in FIGS. 16A and 16B, in the portion where the discharge is most likely to proceed, the discharge characteristic is also shifted by the discharge starting voltage difference to the side where the discharge current easily flows. Therefore, the discharge amount excessively flows in the portion where the discharge is likely to proceed. Where the discharge amount is large, the amount of local scraping on the photosensitive drum 3 increases and local scratches may appear on the photosensitive drum 3.

The change from the charging potential to the exposure potential which is induced by exposure is caused by generation of carriers on the photosensitive drum 3 by exposure (holes when the charging is negative and electrons when the charging is positive) and neutralization of the surface charge by the carriers. However, the exposure potential depends not only on the neutralized surface charge but also on the electrostatic capacitance of the drum. Thus, the exposure potential can be represented by the following simple equation:

$$Vl = Vd + qd/\varepsilon \tag{4}$$

Here, q is the charge of the carriers per unit area, d is the film thickness of the photosensitive drum 3, and ε is the dielectric constant. Strictly speaking, q also depends on the film thickness and Equation (4) becomes a bit more complicated, but the relationship itself does not change much, and as the film thickness decreases, Vl approaches Vd. In other words, in the scratched area where the film thickness is small, the exposure potential sometimes does not fall sufficiently even upon the exposure, and when solid black or the like is printed, there is no printing on the scratched portion, and a vertical white streak appears in the image.

The correction method of the present example reduces the sandy zone while suppressing the occurrence of vertical white streaks in an image by reducing the scraping amount of the photosensitive drum.

As a specific method, V0−(Vacth(ave)−Vacth(min)) is set as a scraping amount allowable threshold (Vth) with respect to the AC bias (V0) at the time of the discharge amount (I0) causing the allowable limit scraping amount. Here, Vacth (min) is the AC bias partial discharge starting voltage in the region where the discharge is most likely to proceed. I0 is obtained in advance by examination or the like and stored in the CPU 20 or the like. In FIG. 16A, the AC bias at the intersection of the dash-dot line which passes through the discharge amount I0 and is parallel to the abscissa and the solid line showing the relationship for the entire photosensitive drum 3 is V0. Further, as shown in FIG. 16A, the Vth which is determined, as described hereinabove, with respect to the V0 is the AC bias at the point where the coarse broken line showing the relationship in the region where the discharge is most likely to proceed intersects the dash-dot line which passes through I0 and is parallel to the abscissa. In this case, the intersection of the broken line which passes through Vth and is parallel to the ordinate and the fine broken line indicating the relationship in the region where the discharge is most unlikely to proceed is C. Thus, the relationship in the region where the discharge is most unlikely to proceed when the AC bias is set so as to obtain the discharge amount (I0) causing the allowable limit scraping amount in the region where the discharge is most likely to proceed is indicated by C. The value of the AC bias at the intersection B of the broken line that passes through the target value of the discharge amount and is parallel to the abscissa and the coarse broken line indicating the relationship in the region where the discharge is most likely to proceed is the value of the AC bias such that the discharge amount in the region where the discharge is most unlikely to proceed becomes the target value. Further, where the AC bias at the intersection B is less than the AC bias at the intersection C, as shown in FIG. 16A, the AC bias is corrected from the intersection A to the intersection B. Thus, Vacth(max)−Vacth(ave) which is the difference between the AC bias value at the intersection B and the AC bias value at the intersection A is added to the AC bias that reaches the target discharge amount as a whole. Here, Vacth(max) is the AC bias partial discharge starting voltage in the region where the discharge is most likely to proceed, and Vacth (max)−Vacth(ave) is obtained from Equation (3) above. As a result, the target discharge amount also flows in the portion where the discharge is most unlikely to proceed. Further, since the AC bias at the intersection B is smaller than the AC bias at the intersection C, even if the AC bias is corrected from the intersection A to the intersection B, the allowable limit scraping amount is not exceeded even in the region where the discharge is most likely to proceed.

Where the AC bias at the intersection B is larger than the AC bias at the intersection C as shown in FIG. 16B, the AC bias is set to Vth and the discharge amount is controlled so as not to rise further. This is because where the AC bias is corrected from the intersection A to the intersection B in the same manner as shown in FIG. 16A, since the AC bias at the intersection B is larger than the AC bias at the intersection C, the discharge amount (I0) causing the allowable limit scraping amount is exceeded in the region where the discharge is most likely to proceed. As a result, even the portion where the discharge is most likely to proceed can be maintained at the allowable limit scraping amount.

With this correction method, the sandy zone can be suppressed while suppressing the occurrence of vertical white streaks in the image by reducing the scraping amount of the photosensitive drum.

<Confirmation of Effect>

In order to confirm the effect of the present example, an image defect caused by poor charging was confirmed in the abovementioned correction method and the comparative example which is the conventional discharge current control method. In the configuration of the comparative example, by contrast with the configuration of the present example, the conventional discharge current control is performed without correcting the charging bias output value. Other features are the same as those in the present example, so the description thereof is omitted. Measurement was carried out by intermittently feeding 30,000 sheets of Canon CS 680 paper sheet of a B5 size by two sheets at a 4% print percentage and printing one solid white image and one solid black image with Canon CS 680 paper of an A3 size every 5000 sheets. The paper was fed to pass through the central portion of the photosensitive drum 3. As an image defect caused by poor charging, the solid white image was checked for the presence or absence of a sandy zone and the level thereof. As an image defect caused by the scraping of the photosensitive drum, the solid white image was checked for the presence or absence of white streaks and the level thereof.

The results are shown in Table 1. The reference symbol ○ in the "Sandy zone" sections in the table represents the case in which no sandy zone has occurred. The reference symbol Δ represents the case in which sandy zones have occurred, but the number thereof is not more than 5 per 1 $cm^2$, and the reference symbol x represents the case in which the number of the sandy zones is more than 5 per 1 $cm^2$. The reference symbol ○ in the "Vertical white streaks" sections in the table represents the case in which no vertical white streak has occurred. The reference symbol Δ represents the case in which vertical white streaks are slightly visible, and the reference symbol x represents the case in which vertical white streaks are clearly visible. As seen from the results, in the comparative example, the sandy zones occurrence at the time of 25,000 sheets feed is represented by Δ, whereas in the present example no sandy zone has occurred. Further, it can be seen that vertical white streaks have not occurred. Thus, it was found that in the present example, the sandy zone can be suppressed while suppressing the scraping amount of the photosensitive drum 3.

TABLE 1

| | | Number of passing paper sheets ($\times 10^3$) | | | | | | |
|---|---|---|---|---|---|---|---|---|
| | | 0 | 5 | 10 | 15 | 20 | 25 | 30 |
| Example 1 | Sandy zone | ○ | ○ | ○ | ○ | ○ | ○ | ○ |
| | Vertical white streaks | ○ | ○ | ○ | ○ | ○ | ○ | ○ |
| Comparative Example | Sandy zone | ○ | ○ | ○ | ○ | ○ | Δ | Δ |
| | Vertical white streaks | ○ | ○ | ○ | ○ | ○ | ○ | ○ |

<Flowchart>

Figure 1:
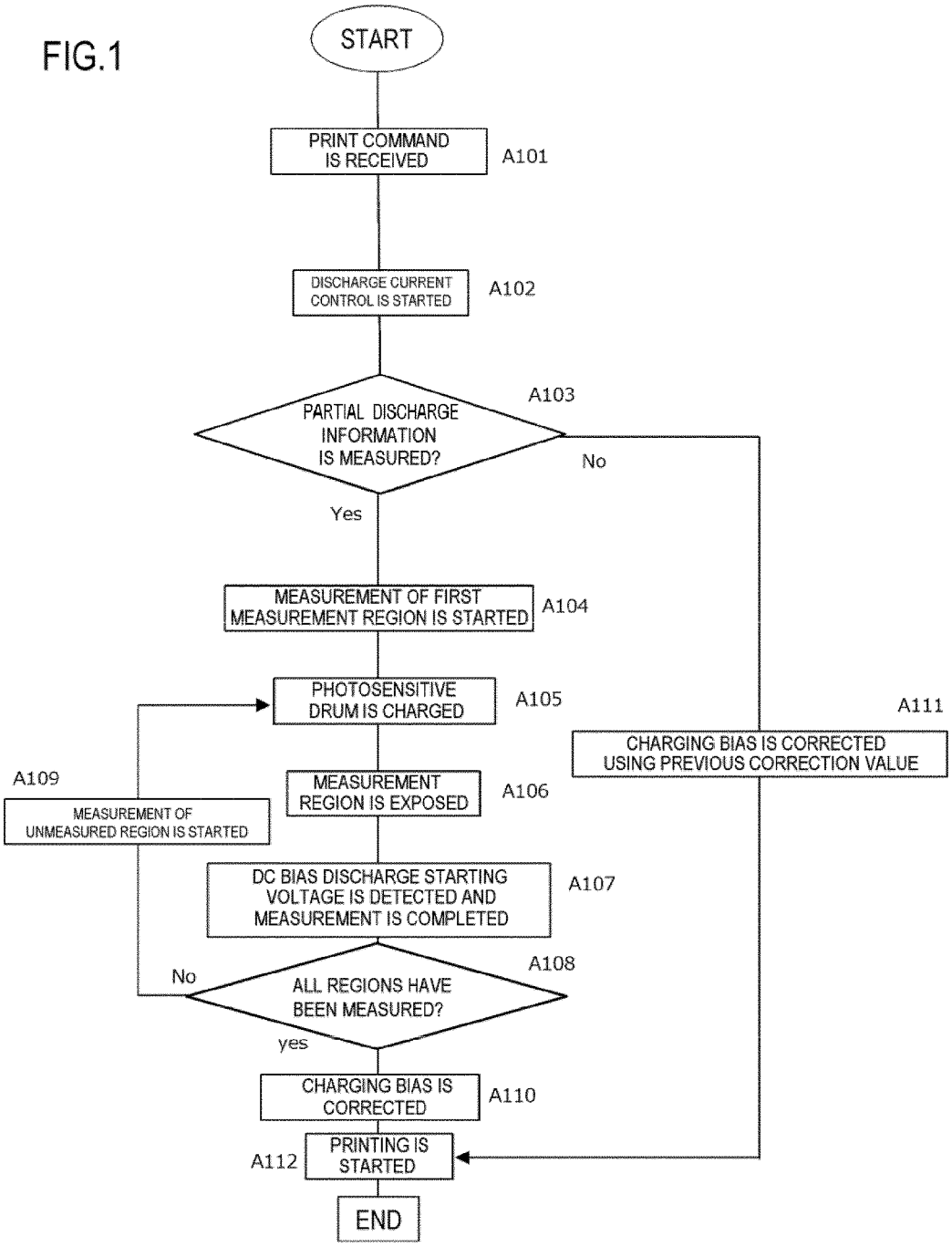
FIG. 1 is a flowchart diagram according to Example 1.

Next, an image forming method including a detection flow of partial discharge information in the longitudinal direction in the present example will be described with reference to the flowchart shown in FIG. 1.

First, when a print command is received by the image forming apparatus 1 (A101), the discharge current control is started (A102), and a charging bias for obtaining the target discharge amount is determined. Then, it is determined whether or not partial discharge information is detected (A103). Since the unevenness of the discharge in the longitudinal direction is caused by a temporal change such as scraping unevenness in the longitudinal direction of the photosensitive drum 3 and unevenness of contamination of the charging roller 6, it is not necessary to measure the partial discharge information at all times. In the configuration of the present example, it is known that it takes about 1000 sheets from occurrence to actual realization. Therefore, in the present example, partial discharge information is measured once every 1000 sheets, and when it is determined that partial discharge information is not to be detected, the correction is performed by using data that were most recently stored in the CPU 20 as a correction value (A111). However, such a procedure is not limiting and the measurement may be performed at a frequency corresponding to the configuration of the image forming apparatus. When it is determined that partial discharge information is to be detected, measurement of the first measurement region is started (A104). First, a bias sufficient for uniformly charging the photosensitive drum 3 with the charging roller 6 is applied (A105). Then, the measurement region is exposed (A106), and the DC bias discharge starting voltage is detected with the DC bias discharge starting voltage detection circuit 34 (A107). When the measurement is completed, it is determined whether or not all the regions have been measured (A108). Where it is determined that not all the measurement regions have yet been measured, the region which has not yet been measured is taken as the measurement region (A109), the processing returns to A105 and the measurement is started. Where it is determined that all the measurement regions have been measured, the charging bias for discharge current control is corrected (A110) on the basis of the measured value, and printing is started (A112).

By carrying out the flow as described above, it is possible to detect the partial discharge starting voltage as the partial discharge information and correct the charging bias.

Further, a nonvolatile memory may be installed in a process cartridge and information or the like to be used for determining a bias voltage such as a target discharge current value, a mode of use, and operating environment may be stored in the nonvolatile memory. Since the process cartridge is detachable from the image forming apparatus main body and information can be provided for each process cartridge by a nonvolatile memory, an appropriate bias can be set for each process cartridge.

The configuration of the present example is not limiting. Speed, exposure amount, etc. are just examples for carrying out the present example. Further, in the present example, the discharge starting voltage is detected as the discharge information and the partial discharge starting voltage is measured as the partial discharge information, but such procedure is not limiting and, for example, it is possible to detect the discharge current as discharge information and measure a discharge current at a partial region (referred to hereinbelow as a partial discharge current). In the case of detecting the discharge current, it is possible to detect the discharge unevenness in the longitudinal direction, for example, by detecting the partial discharge current under a constant charging voltage.

Example 2

In Example 1, a correction method was described by which sandy zones were suppressed while reducing the scraping amount of the photosensitive drum 3 and suppressing the occurrence of vertical white streaks in the image. The present example is characterized in relating to a correction method for suppressing the occurrence of sandy zones even in a configuration having a longer life. The description of components same as those in Example 1 will be omitted.

Figure 17:
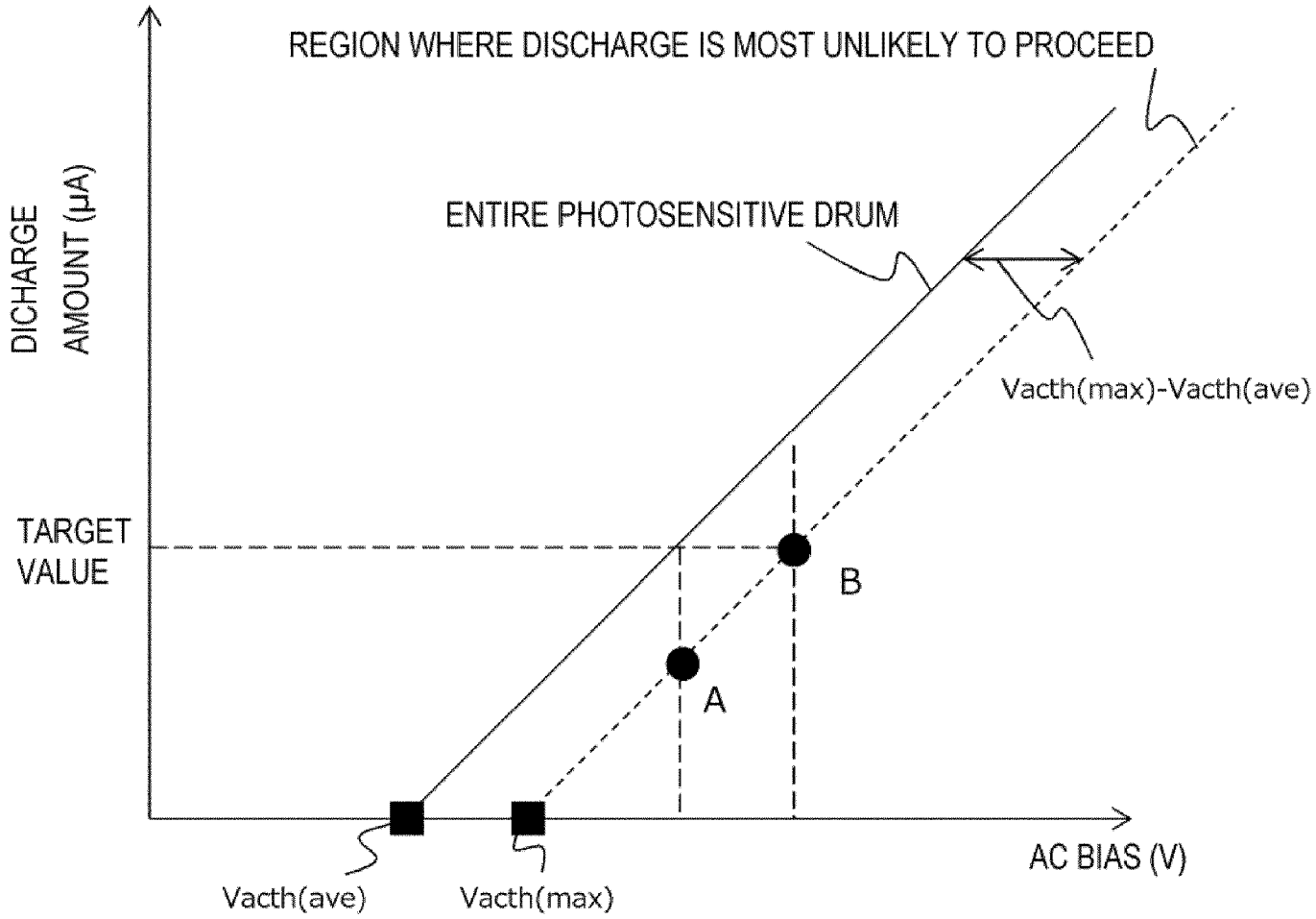
FIG. 17 is a graph showing the relationship between the discharge amount and the AC bias according to Example 2.
Figure 18:
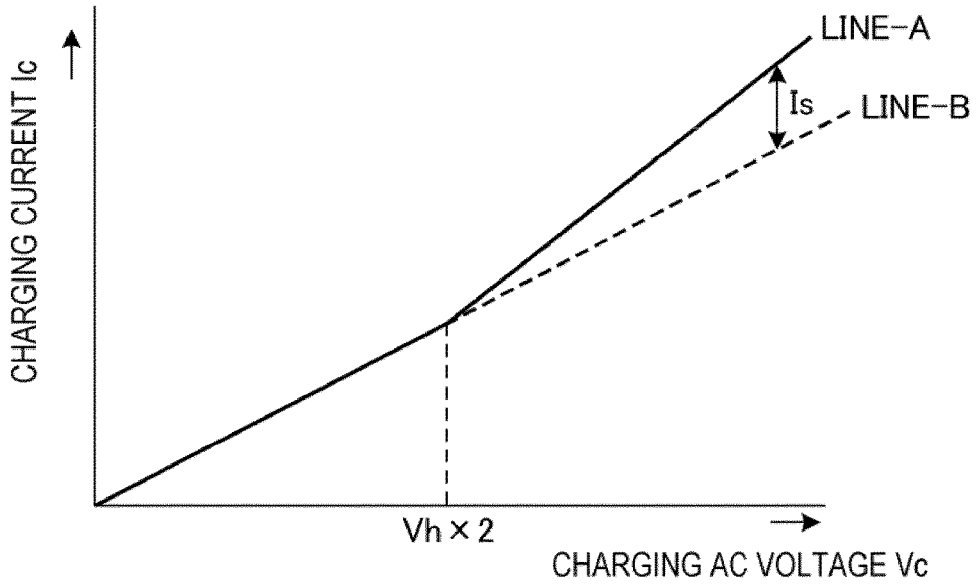
FIG. 18 shows the characteristics of current flowing through the charging roller when an AC voltage is applied to the charging roller.

FIG. 17 shows the relationship between the discharge amount and the AC bias. As shown in FIG. 17, the discharge characteristic shifts by the discharge starting voltage difference in the portion where the discharge is most unlikely to proceed. Therefore, even when the total discharge amount has reached the target discharge amount, the discharge amount has not reached the target discharge amount in the portion where the discharge is unlikely to occur (A in FIG. 17). In such a case, a sandy zone may be generated as described in the section concerning problems of the related art. In such a case, the correction method of Example 1 is effective, but where the number of printed sheets increases due to a longer life, it is sometimes difficult to suppress the sandy zone.

Accordingly, in the present example, the threshold is eliminated and the AC bias is corrected from A to B in FIG. 17 to eliminate the sandy zone. In other words, Vacth (max)−Vacth(ave) is always added to the AC bias.

With this correction method, since the target discharge amount flows in the portion where the discharge is most unlikely to proceed in the longitudinal direction, the sandy zone can be suppressed.

<Confirmation of Effect>

In order to confirm the effect of the present example, the effect confirmation was performed in the same manner as in Example 1. There were three confirmation items: the present example, Example 1, and the comparative example used in Example 1. Further, since the effect of the present example is in the suppression of sandy zones, the confirmation was performed only with respect to the sandy zones. Measurement is the same as in Example 1, and the explanation thereof is therefore omitted.

The confirmation results are shown in Table 2. According to the results, it is clear that no sandy zone has occurred in the present example. From this, it was found that in the present example, it is possible to suppress the sandy zone.

TABLE 2

| | | Number of passing paper sheets ($\times 10^3$) | | | | | | | | | | |
|---|---|---|---|---|---|---|---|---|---|---|---|---|
| | | 0 | 5 | 10 | 15 | 20 | 25 | 30 | 35 | 40 | 45 | 50 |
| Example 2 | Sandy zone | ○ | ○ | ○ | ○ | ○ | ○ | ○ | ○ | ○ | ○ | ○ |
| Comparative example | Sandy zone | ○ | ○ | ○ | ○ | ○ | Δ | Δ | x | x | x | x |
| Example 1 | Sandy zone | ○ | ○ | ○ | ○ | ○ | ○ | ○ | ○ | Δ | Δ | Δ |

The configuration of the present example is not limiting. Speed, exposure amount, etc. are just examples for carrying out the present example. Further, in the present example, the discharge starting voltage is detected as the discharge information and the partial discharge starting voltage is measured as the partial discharge information, but such procedure is not limiting and, for example, it is possible to detect the discharge current as discharge information and measure a partial discharge current.

Example 3

In Examples 1 and 2, the partial discharge information was detected using the partial measurement region for partial discharge information detection as an exposure portion. In the present example, the partial measurement region for partial discharge information detection is taken as a non-exposure portion which is not to be exposed by the laser scanner 4, and a non-measurement region excluding the partial measurement region is taken as an exposure portion which is to be exposed by the laser scanner 4. In the present example, different potentials are thus set in the partial measurement region and the region excluding the partial measurement region. As a result, the detection accuracy of the partial discharge information is improved relative to Examples 1 and 2, and the occurrence of sandy zones is suppressed even in a configuration having a longer life. The description of components same as those in Examples 1 and 2 will be omitted. Further, in the present example, the partial discharge starting voltage was measured as the partial discharge information.

Figure 20:
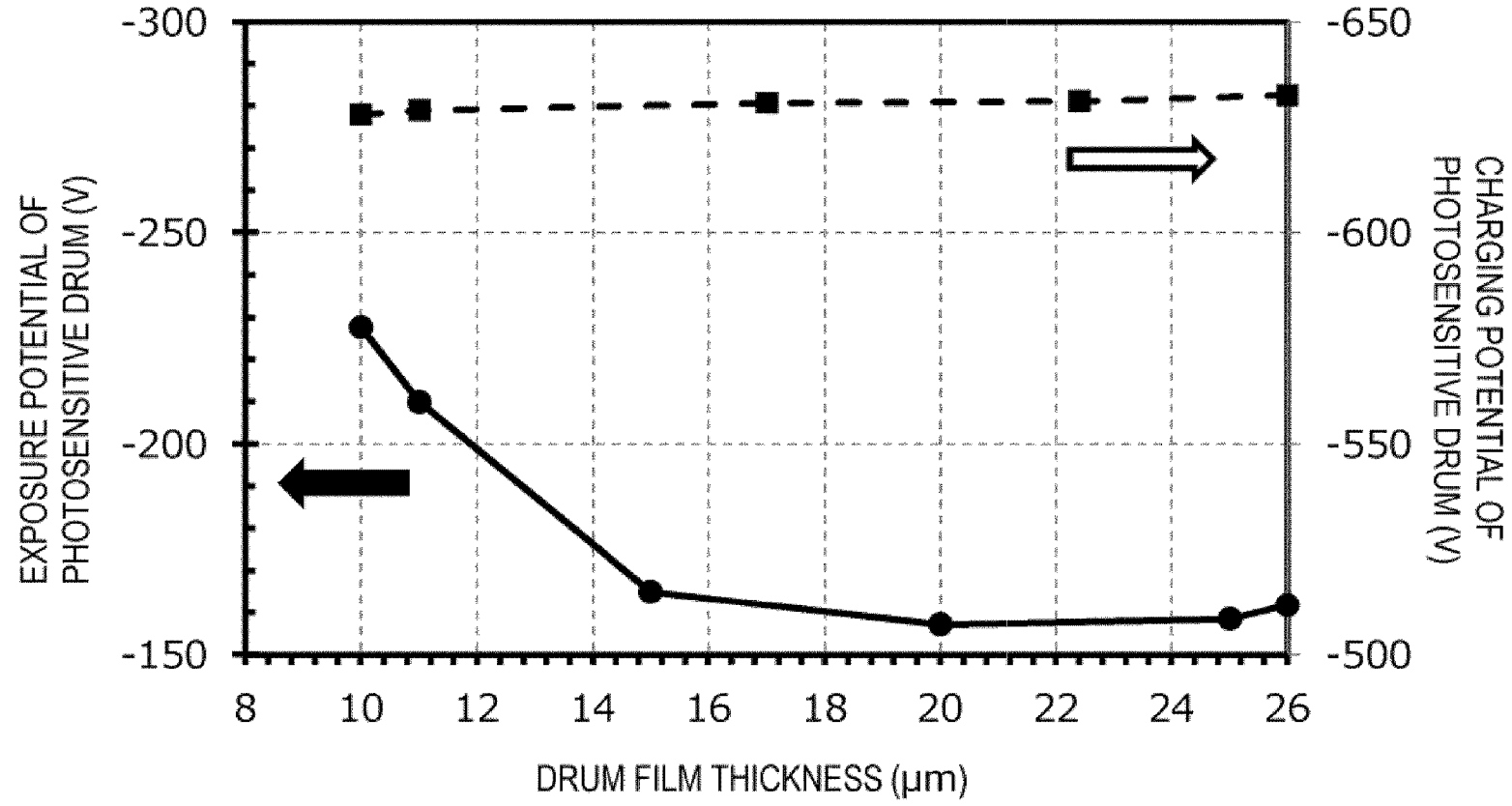
FIG. 20 is a graph showing the relationship between the potential and the film thickness of the photosensitive drum according to Example 3.

In Example 1, when the DC bias partial discharge starting voltage Vdcth(i) was obtained, it was considered that the term of the exposure potential Vl was included and it was assumed that the exposure potential VlI did not change greatly in the longitudinal direction. However, for example, as the film of the photosensitive drum 3 becomes thinner, the exposure potential sometimes greatly changes depending on the film thickness of the photosensitive drum 3 even when the charging potential is made uniform in the longitudinal direction. In FIG. 20, the change in potential of the exposure portion and the non-exposure portion of the photosensitive drum 3 in relation to the film thickness is indicated by a solid line. When the film of the photosensitive drum 3 becomes thin, the dependency of the exposure potential on the film thickness is large, and the difference in exposure potential caused by the difference in film thickness difference is large. Such a relationship becomes remarkable due to the longer life of image forming apparatuses which has been achieved in recent years.

In such a case, the exposure potential Vl is considered to be different in the measurement region (Vl=Vl(i)), Equation (3) cannot be obtained from Equation (2), and Equation (5) is obtained.

$$Vacth(i)-Vacth(ave)=2(Vdcth(i)-Vdcth(ave))+2(|Vl(ave)|-|Vl(i)|) \quad \text{Equation (5).}$$

In other words, an error represented by the second term on the right side of Equation (5) occurs. Where correction is made using Equation (3) in such a state, the correction can involve the reduction by 2(|Vl(ave)|−|Vl(i)|). For example, in the case where discharge unevenness has occurred due to the difference in film thickness, even when attempting to detect a region with a high partial discharge starting voltage, the region with a high partial discharge starting voltage is a thick region, and therefore |Vl(ave)|>|Vl(i)|. Thus, the correction involved the reduction by 2(|Vl(ave)|−|Vl(i)|) (>0), sufficient bias could not be applied, and sandy zones sometimes occurred.

Accordingly, in the present example, the influence of the exposure potential is avoided by setting the partial measurement region as a non-exposure portion. Therefore, the partial discharge starting voltage can be detected accurately. The detection of the partial discharge starting voltage in the region to be measured as a non-exposure portion. Therefore, the partial discharge starting voltage can be detected accurately.

<Confirmation of Effect>

In order to confirm the effect of the present example, the effect confirmation was performed in the same manner as in Example 2. There were four confirmation items: the present example, Example 1, Example 2, and the comparative example used in Example 1. Measurement is the same as in Examples 1 and 2, and the explanation thereof is therefore omitted. The confirmation results are shown in Table 3. As can be seen from the results, in the present example, the occurrence of sandy zone could be suppressed to a greater degree than in Examples 1 and 2.

This is apparently because in Examples 1 and 2, sufficient bias correction could not be performed due to the measurement error caused by the dependency of the exposure voltage on the film thickness, as described above, in the latter half of the number of passing paper sheets. By contrast, in the present example, it can be seen that the correction is made properly.

TABLE 3

| | | | Number of passing paper sheets ($\times 10^3$) | | | | | | | | | | | | | | |
|---|---|---|---|---|---|---|---|---|---|---|---|---|---|---|---|---|---|
| | | | 0 | 5 | 10 | 15 | 20 | 25 | 30 | 35 | 40 | 45 | 50 | 55 | 60 | 65 | 70 |
| Correction method ① | Example 3 | Sandy zone | ○ | ○ | ○ | ○ | ○ | ○ | ○ | ○ | ○ | ○ | ○ | ○ | ○ | ○ | ○ |
| | Comparative example | Sandy zone | ○ | ○ | ○ | ○ | ○ | Δ | Δ | x | x | x | x | x | x | x | x |
| | Example 2 | Sandy zone | ○ | ○ | ○ | ○ | ○ | ○ | ○ | ○ | ○ | ○ | ○ | ○ | Δ | Δ | x |
| | Example 1 | Sandy zone | ○ | ○ | ○ | ○ | ○ | ○ | ○ | ○ | ○ | Δ | Δ | Δ | Δ | x | x |

longitudinal direction in the present example will be described in detail below with reference to FIGS. 19A to 19C. The horizontal direction in FIGS. 19A to 19C indicates the position in the longitudinal direction, and the vertical direction represents the potential.

Figure 19A:
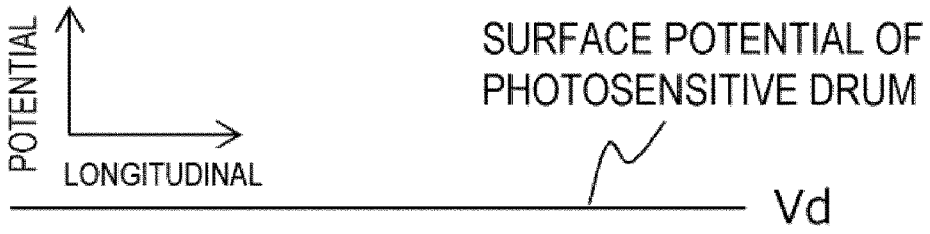
FIGS. 19A, 19B and 19C are schematic diagrams of a discharge starting voltage detection method according to Example 3.
Figure 19B:
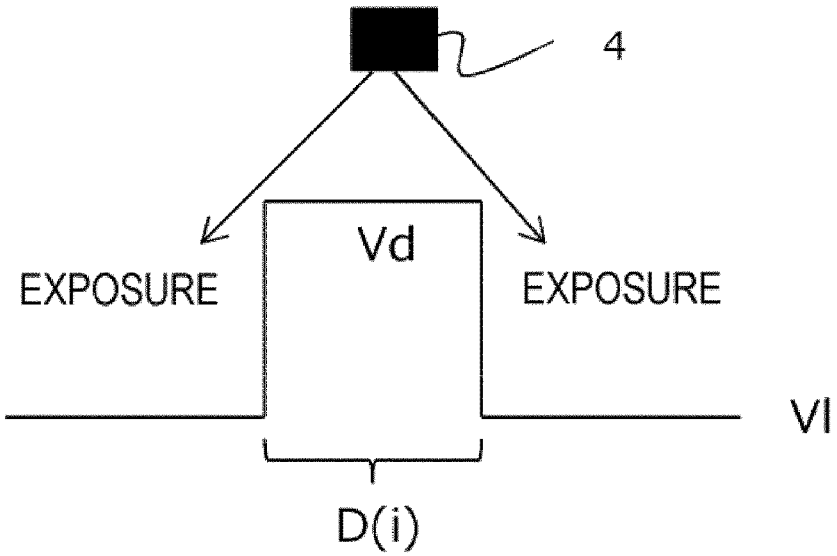
Figure 19C:
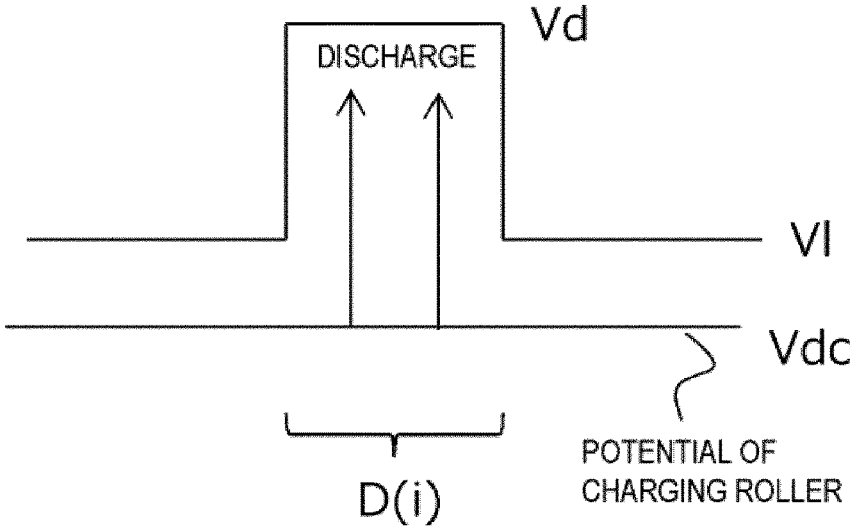

First, as shown in FIG. 19A, the photosensitive drum 3 is uniformly charged (charging potential: Vd). Then, as shown in FIG. 19B, a region other than the partial measurement region D(i) is exposed by the laser scanner 4 to an exposure potential (Vl). Further, as shown in FIG. 19C, a DC bias (Vdc) is applied to the charging roller 6 by using the DC bias discharge starting voltage detection circuit 34, and a DC bias discharge starting voltage is measured in a region where only the partial measurement region D(i) is discharged. As a result, the DC bias partial discharge starting voltage Vdcth(i) of the partial measurement region D(i) is obtained. Where the electrostatic capacity of the photosensitive drum 3 in the partial measurement region D(i) is denoted by Cd(i) and the electrostatic capacitance between the charging roller 6 and the photosensitive drum 3 is denoted by C(i), the DC bias discharge starting voltage is Vdcth(i)=(1+C(i)/Cd(i)) Vpa+Vd. Here, Vpa is a Paschen voltage which is a function of air pressure and gap distance. As indicated by a broken line in FIG. 20, since the charging potential is uniformly charged by the AC bias regardless of the film thickness, the charging potential does not depend greatly on the film thickness. Therefore, Equation (3) can be obtained in the same manner as in Example 1.

$$Vacth(i)-Vacth(ave)=2(Vdcth(i)-Vdcth(ave)) \quad \text{Equation (3)}$$

In other words, in the present example, the influence of changes in the exposure potential is avoided by setting the The configuration of the present example is not limiting. Speed, exposure amount, etc. are just examples for carrying out the present example. Further, in the present example, the discharge starting voltage is detected as the discharge information and the partial discharge starting voltage is measured as the partial discharge information, but such procedure is not limiting and, for example, it is possible to detect the discharge current as discharge information and measure a partial discharge current.

Example 4

In Examples 1 to 3, the DC bias discharge starting voltage detection circuit 34 was used for partial discharge starting voltage detection as partial discharge information detection. In the configuration explained in the present example, the same effect as in Example 1 can be obtained even when the discharge current control circuit 33 is used for partial discharge starting voltage detection. Thus, in the present example, the discharge current control circuit 33 constitutes discharge information detection unit. Components same as in Example 1 are assigned with the same reference numerals and explanation thereof is omitted. In the present example, the partial discharge starting voltage was measured as the partial discharge information.

Figure 21A:
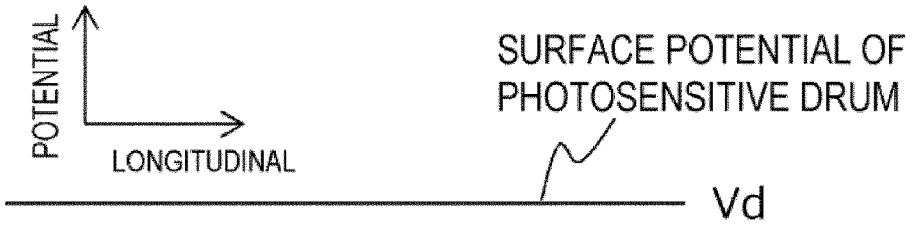
FIGS. 21A, 21B and 21C are schematic diagrams of a discharge starting voltage detection method according to Example 4.
Figure 21B:
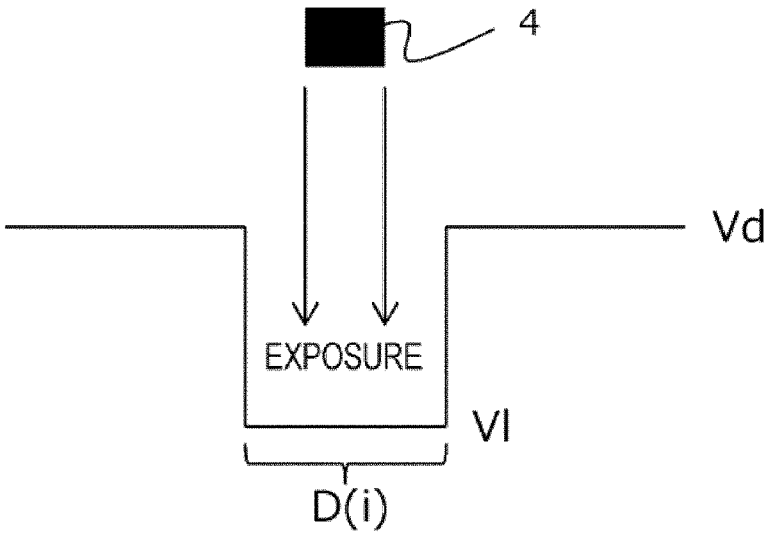
Figure 21C:
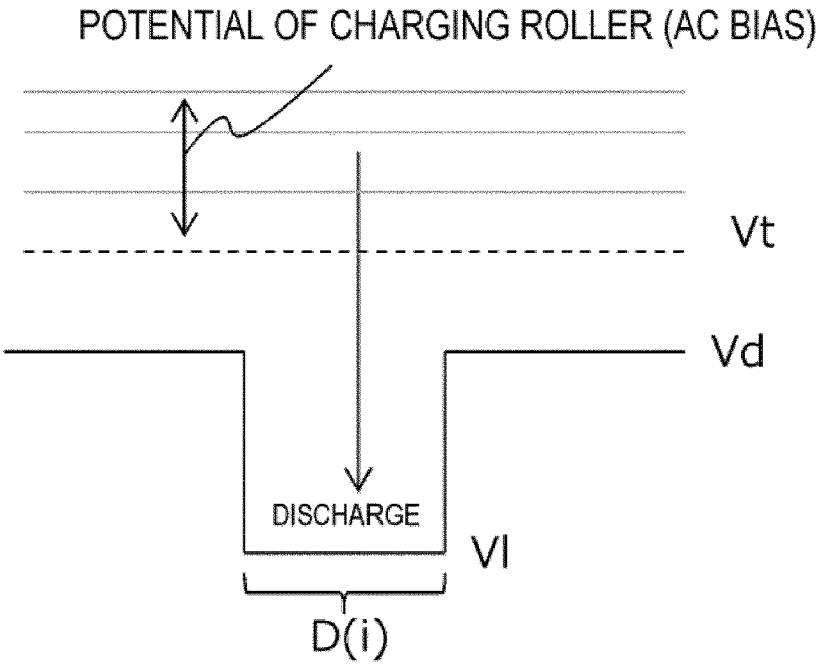

Detection of the partial discharge starting voltage in the longitudinal direction will be described with reference to FIGS. 21A to 21C. In FIGS. 21A to 21C, the position in the longitudinal direction is plotted against the abscissa and the potential is plotted against the ordinate.

Figure 22:
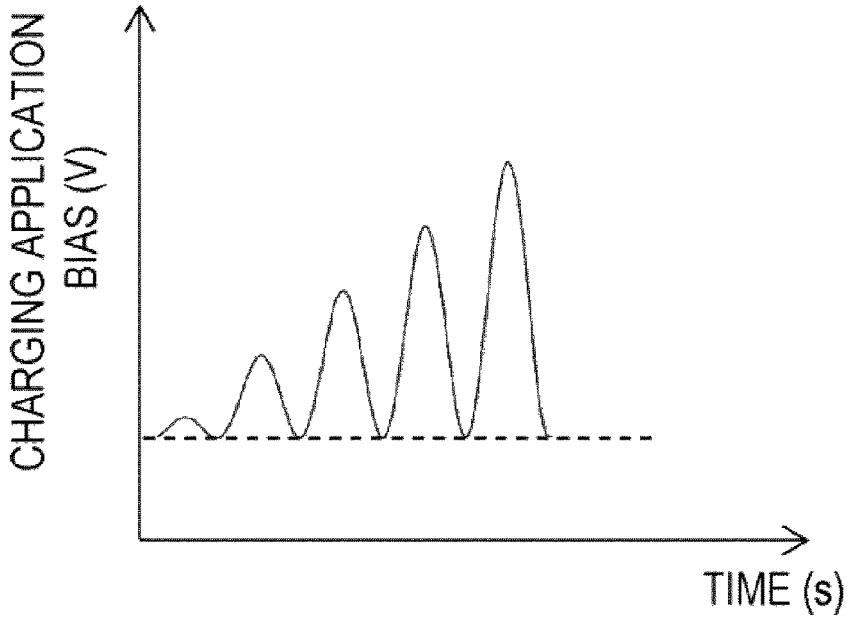
FIG. 22 is an AC bias at the time of discharge starting voltage detection according to Example 4.

First, as shown in FIG. 21A, the photosensitive drum 3 is uniformly charged (charging potential: Vd). Next, as shown in FIG. 21B, only the partial measurement region D(i) is exposed by the laser scanner 4 to the exposure potential (Vl). Then, as shown in FIG. 21C, a DC+AC bias is applied to the charging roller 6 by using the discharge current control circuit 33. At this time, the bias is such that the peak is fixed (Vt) on one side and amplified on the other side, as shown in FIG. 21C. Specifically, the DC bias is set to be Vt+Vac/2 so as to be linked with the AC bias. Here, Vt is set as the bias in the region where the discharge does not start. For example, it may be set to Vd or a value in the vicinity thereof. FIG. 22 shows how the applied AC charging bias changes with time. As shown in FIG. 22, gradual amplification proceeds on one side, and the discharge starting voltage is measured in a state in which only the partial measurement region D(i) is discharged. As a result, the partial measurement region D(i) starts discharging and the discharge starting voltage Vacth'(i) of the partial measurement region D(i) is obtained.

The magnitude of the discharge starting voltage Vacth'(i) is Vacth'(i)=(1+C(i)/Cd(i))Vpa+|Vl|−|Vt|.

Further, the AC bias discharge starting voltage Vacth(i) can be written as Vacth(i)=2Vpa (1+C(i)/Cd(i)) as in Example 1. Therefore, a relational expression Vacth(i)=2 (Vacth'(i)−|Vl|+|Vt|) . . . Equation (6) is satisfied.

Where the average of the discharge starting voltage Vacth'(i) is denoted by Vacth'(ave) and the average of the AC bias discharge starting voltage is denoted by Vacth(ave), Equation (7) can be obtained from this relational expression.

$$Vacth(i)-Vacth(ave)=2(Vacth'(i)-Vacth'(ave)) \quad \text{Equation (7).}$$

The AC bias discharge starting voltage of the measurement region D(i) can be detected with this Equation (7). In the present example, the partial measurement region is taken as the exposure portion, but it may be a non-exposure portion as in Example 3.

The effect confirmation for the present example was performed in the same manner as in Example 1, and the same results as in Table 1 of Example 1 were obtained. Thus, the present example demonstrated that the same effect as in Example 1 can be obtained even when the discharge current control circuit 33 is used for partial discharge starting voltage detection.

The configuration of the present example is not limiting. Speed, exposure amount, etc. are just examples for carrying out the present example. Further, in the present example, the discharge starting voltage is detected as the discharge information and the partial discharge starting voltage is measured as the partial discharge information, but such procedure is not limiting and, for example, it is possible to detect the discharge current as discharge information and measure a partial discharge current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-110417, filed on Jun. 1, 2016, and Japanese Patent Application No. 2017-91436, filed on May 1, 2017, which are hereby incorporated by reference herein in their entirety.

What is claimed is:

1. An image forming apparatus comprising:

a rotatable image bearing member that bears a latent image;

an exposure unit for exposing the image bearing member;

a charging member that charges the image bearing member;

a bias applying unit for applying a bias voltage to the charging member;

a discharge amount detection unit for detecting a current amount discharged between the charging member and the image bearing member;

a discharge current control unit for determining a bias voltage to be applied to the charging member from the discharge current amount detected by the discharge amount detection unit; and a discharge information detection unit for detecting discharge information which is information on discharge between the charging member and the image bearing member, wherein the discharge information detection unit sets, in a part of a printable region on the surface of the image bearing member, a region, which has a width in a direction perpendicular to the rotation direction that is less than a width of the printable region, as a partial measurement region, and detects partial discharge information on discharge between the partial measurement region and the charging member when the exposure unit forms different potentials in the partial measurement region and a region excluding the partial measurement region after the image bearing member is charged to a constant potential by the charging member, and the discharge current control unit corrects the bias voltage in image formation that is applied to the charging member on the basis of the partial discharge information.

2. The image forming apparatus according to claim 1, wherein the discharge information is a discharge starting voltage.

3. The image forming apparatus according to claim 1, wherein the discharge information is a discharge current.

4. The image forming apparatus according to claim 1, wherein the partial discharge information is detected by setting different potentials in the partial measurement region and the region excluding the partial measurement region by setting the partial measurement region as an exposure portion which is to be exposed by the exposure unit and setting the region excluding the partial measurement region as a non-exposure portion which is not to be exposed by the exposure unit.

5. The image forming apparatus according to claim 1, wherein the partial discharge information is detected by setting different potentials in the partial measurement region and the region excluding the partial measurement region by setting the partial measurement region as a non-exposure portion which is not to be exposed by the exposure unit and setting the region excluding the partial measurement region as an exposure portion which is to be exposed by the exposure unit.

6. The image forming apparatus according to claim 1, wherein the discharge information detection unit detects the discharge information in a case where a DC bias voltage is applied to the charging member.

7. The image forming apparatus according to claim 1, wherein the discharge information detection unit detects the discharge information in a case where an AC bias voltage is applied to the charging member in superimposition on a DC bias voltage.

8. The image forming apparatus according to claim 7, wherein the discharge information is detected in a case where the AC bias voltage is applied to the charging member in superimposition on the DC bias voltage by the discharge current control unit.

9. The image forming apparatus according to claim 1, wherein the partial measurement region is set according to a width of a recording material.

10. A process cartridge detachably mounted on a main body of the image forming apparatus according to claim 1, the process cartridge comprising:

the image bearing member;

the charging member; and a nonvolatile memory that stores information to be used for determining a bias voltage.

11. An image forming method implemented in an image forming apparatus that includes:

a rotatable image bearing member that bears a latent image;

an exposure unit for exposing the image bearing member;

a charging member that charges the image bearing member;

a bias applying unit for applying a bias voltage to the charging member;

a discharge amount detection unit for detecting a current amount discharged between the charging member and the image bearing member; and a discharge current control unit for determining a bias voltage to be applied to the charging member from the discharge current amount obtained by the discharge amount detection unit, with respect to a partial measurement region which is set in a part of a printable region on the surface of the image bearing member and of which width in a direction perpendicular to the rotation direction is less than a width of the printable region, the image forming method comprises the steps of:

charging the image bearing member to a constant potential by the charging member;

setting different potentials in the partial measurement region and a region excluding the partial measurement region by the exposure unit;

detecting partial discharge information on discharge between the partial measurement region and the charging member; and correcting the bias voltage in image formation that is applied to the charging member on the basis of the partial discharge information.

* * * * *